US009299324B2

(12) United States Patent
van Ekstrom

(10) Patent No.: US 9,299,324 B2
(45) Date of Patent: Mar. 29, 2016

(54) TREMOLO ASSEMBLY

(71) Applicant: Gordon van Ekstrom, Kirkland, WA (US)

(72) Inventor: Gordon van Ekstrom, Kirkland, WA (US)

( * ) Notice: Subject to any disclaimer, the term of this patent is extended or adjusted under 35 U.S.C. 154(b) by 106 days.

(21) Appl. No.: 14/036,850

(22) Filed: Sep. 25, 2013

(65) Prior Publication Data

US 2014/0020545 A1 Jan. 23, 2014

Related U.S. Application Data

(63) Continuation-in-part of application No. 13/308,434, filed on Nov. 30, 2011, now Pat. No. 8,697,969.

(60) Provisional application No. 61/706,079, filed on Sep. 26, 2012.

(51) Int. Cl.

| | |
|---|---|
| ***G10D 3/00*** | (2006.01) |
| ***G10D 3/14*** | (2006.01) |
| *G10D 3/04* | (2006.01) |

(52) U.S. Cl.
CPC . *G10D 3/146* (2013.01); *G10D 3/04* (2013.01)

(58) Field of Classification Search
CPC ..... G10D 3/04; G10D 3/146
USPC ..... 84/313
See application file for complete search history.

(56) References Cited

U.S. PATENT DOCUMENTS 8,895,823 B2 * 11/2014 Musel ..... 84/299
2004/0074373 A1 * 4/2004 Goto ..... 84/452 R

* cited by examiner

*Primary Examiner* — Jianchun Qin

(57) ABSTRACT

A bridge assembly having a saddle plate with a first aperture, and a tremolo block with a second aperture aligned with the first aperture. The tremolo block is attached to the saddle plate, and it has a plurality of arcuate string apertures therethrough configured to receive the strings therein while maintaining contact between the string and the tremolo block along substantially the entire length of the respective string aperture.

18 Claims, 27 Drawing Sheets

TREMOLO ASSEMBLY

CROSS REFERENCE TO RELATED APPLICATIONS

This application claims the benefit of and priority to U.S. Provisional Patent Application No. 61/706,079, titled Tremolo Assembly, filed Sep. 26, 2012, and U.S. patent application Ser. No. 13/308,434, titled Tremolo Assembly, filed Nov. 30, 2011 and issued as U.S. Pat. No. 8,697,969, both of which are incorporated herein in their entirety by reference thereto.

TECHNICAL FIELD

Embodiments of the present invention are directed to tremolos for stringed instruments.

BACKGROUND

Stringed instruments, such as electric guitars have incorporated devices to vary the tension of the strings to change the pitch of the strings. One such tool is a conventional tremolo and a bridge assembly, wherein the tremolo can be moved while a musician is playing the instrument to change the pitch of the strings. Many conventional tremolo arms, however, are rotatable attached to the bridge by screwing the end of the tremolo arm into a threaded hole in the bridge assembly. Over time and through use, the threads on the tremolo arm and the bridge assembly wear, and the tremolo arm loosens and develops excessive travel or "slop" during use. The process of screwing the tremolo arm into place can be slow or inconvenient. Accordingly, there is a need for an improved tremolo system.

SUMMARY

The present invention provides a tremolo assembly that overcome drawbacks experienced in the prior art. In one embodiment, the tremolo assembly is configured to be used with an electric guitar or other suitable stringed musical instrument. The assembly of at least one embodiment includes a tremolo arm removably coupled to a saddle plate, a tremolo block and a bushing. The tremolo block includes a plurality of arcuate passageways therethrough that receive the strings of the stringed instruments. The arcuate passageways include a retention area that receives the ball end of a respective string and prevents the ball end from rotating relative to the tremolo block. In one embodiment, the tremolo assembly is mounted to an electric guitar and is configured to allow a musician to change the pitch of the guitar strings, such as to create a vibrato, while playing by adjusting the tremolo arm. Other embodiments include the tremolo assembly mounted to other stringed musical instruments. The tremolo assembly provides better control and accuracy for the musician when creating a vibrato or otherwise changing the pitch of the strings while playing.

Another embodiment provides a bridge assembly for use with a stringed instrument having a plurality of strings. The bridge assembly has a mounting plate attachable to the instrument, and a bridge block with a top portion connected to the mounting plate and a bottom portion spaced away from the mounting plate. The bridge block has a plurality of arcuate string passageways extending between the top and bottom portions of the bridge block. The arcuate string passageways are configured to receive the strings therein with the strings maintaining contact with the bridge block substantially along the length of the string passageways.

Another embodiment provides a tremolo assembly for use with a stringed instrument having a plurality of strings. The tremolo assembly has a mounting plate with a plurality of string apertures and a first tremolo aperture. A plurality of saddles are attached to the mounting plate adjacent to the string apertures. A bridge block is connected to the mounting plate and has a plurality of arcuate string passageways extending between the top and bottom portions of the bridge block. The arcuate string passageways are aligned with the string apertures in the mounting plate and are configured to receive the strings therein with the strings maintaining contact with the bridge block substantially along the length of the string passageways. The bridge block has a second tremolo aperture aligned with the first tremolo aperture. A tremolo arm is removably disposed in the first and second tremolo apertures.

Another embodiment provides a guitar assembly comprising a neck with a head portion, and a body connected to the neck. A plurality of strings each have a first end portion connected to the head portion of the neck and have a second end portion opposite the first end portion. A bridge assembly is attached to the body. The bridge assembly has a bridge block with a plurality of arcuate string passageways extending between top and bottom portions of the bridge block. The strings extend through the arcuate string passageways with the strings in contact with the bridge block substantially along the length of the string passageways.

DETAILED DESCRIPTION

The present disclosure describes a tremolo assembly in accordance with certain embodiments of the present invention. Several specific details of the invention are set forth in the following description and FIGS. 1-28 to provide a thorough understanding of certain embodiments of the invention. One skilled in the art, however, will understand that the present invention may have additional embodiments, and that other embodiments of the invention may be practiced without several of the specific features described below.

Figure 1:
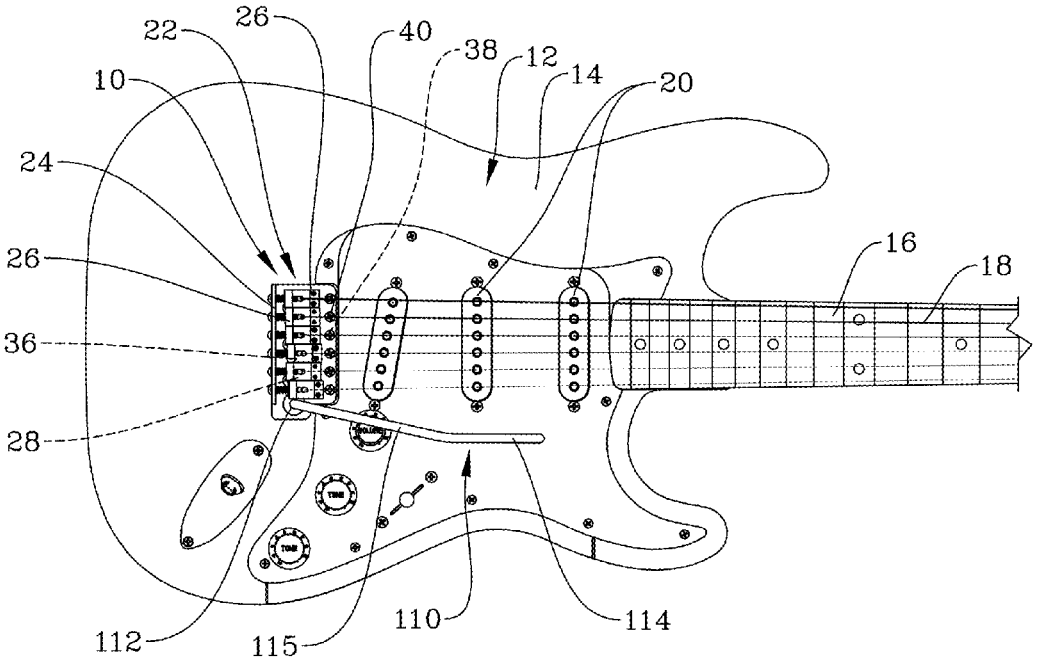
FIG. 1 is a front isometric view of an electric guitar with a tremolo assembly in accordance with an embodiment of the present invention, wherein the tremolo arm is oriented in a raised, playing position.
Figure 13:
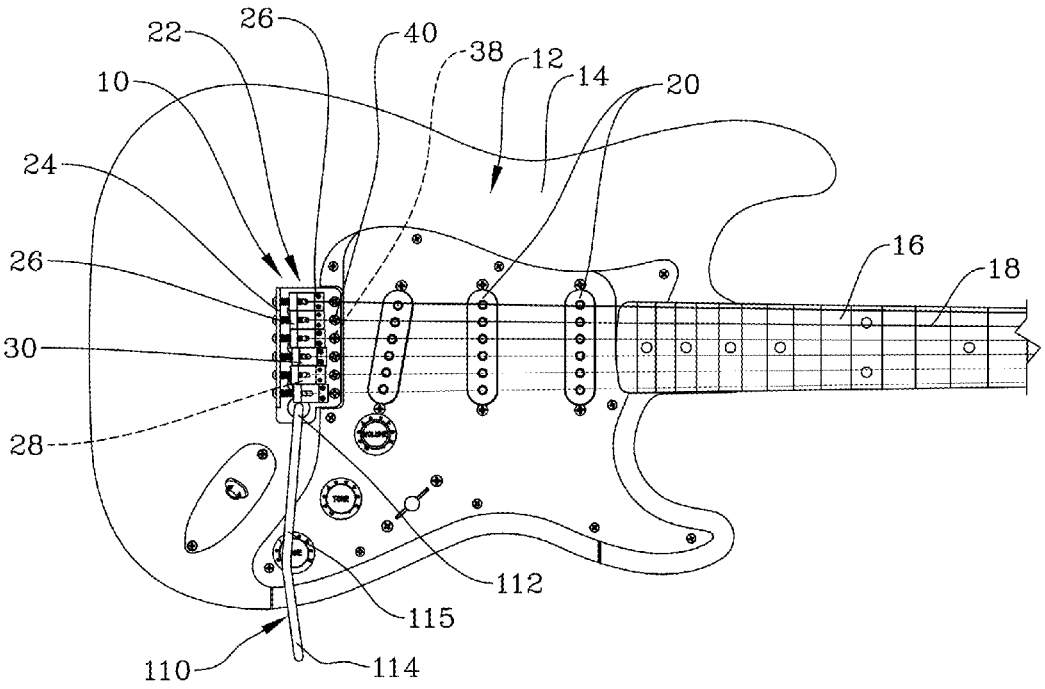
FIG. 13 is a front isometric view of the electric guitar of FIG. 1 with the tremolo assembly rotated to a lowered, inactive position.

Embodiments of the present inventions include the tremolo assembly 10 mountable to an electric guitar 12, shown in FIGS. 1 and 13, that has a body 14, a neck 16, strings 18, a series of pickups 20, and other conventional components of an electric guitar. The tremolo assembly 10 includes a bridge assembly 22 mounted to the guitar body 14. The bridge assembly 22 includes a saddle plate 24 that attaches to the guitar body 14 and that has a plurality of saddle assemblies 26 positioned to support a distal portion of the guitar strings 18. The saddle plate 24 is mounted to a bridge block 28 that anchor the distal ends of the guitar strings 18.

Figure 2:
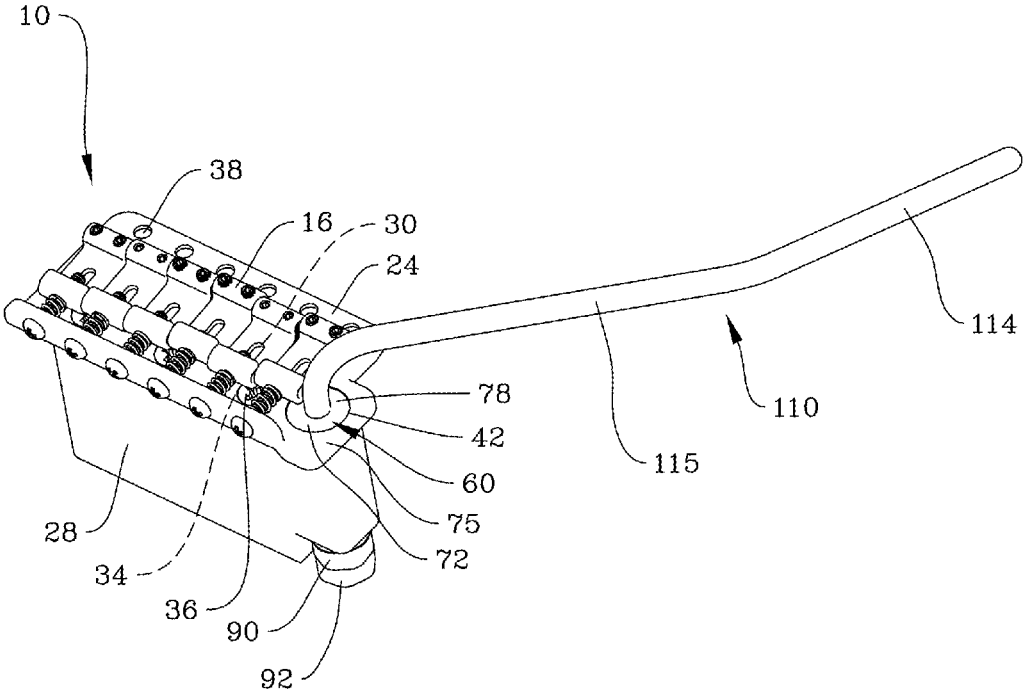
FIG. 2 is an enlarged top isometric view of the tremolo assembly shown removed from the guitar of FIG. 1.
Figure 3:
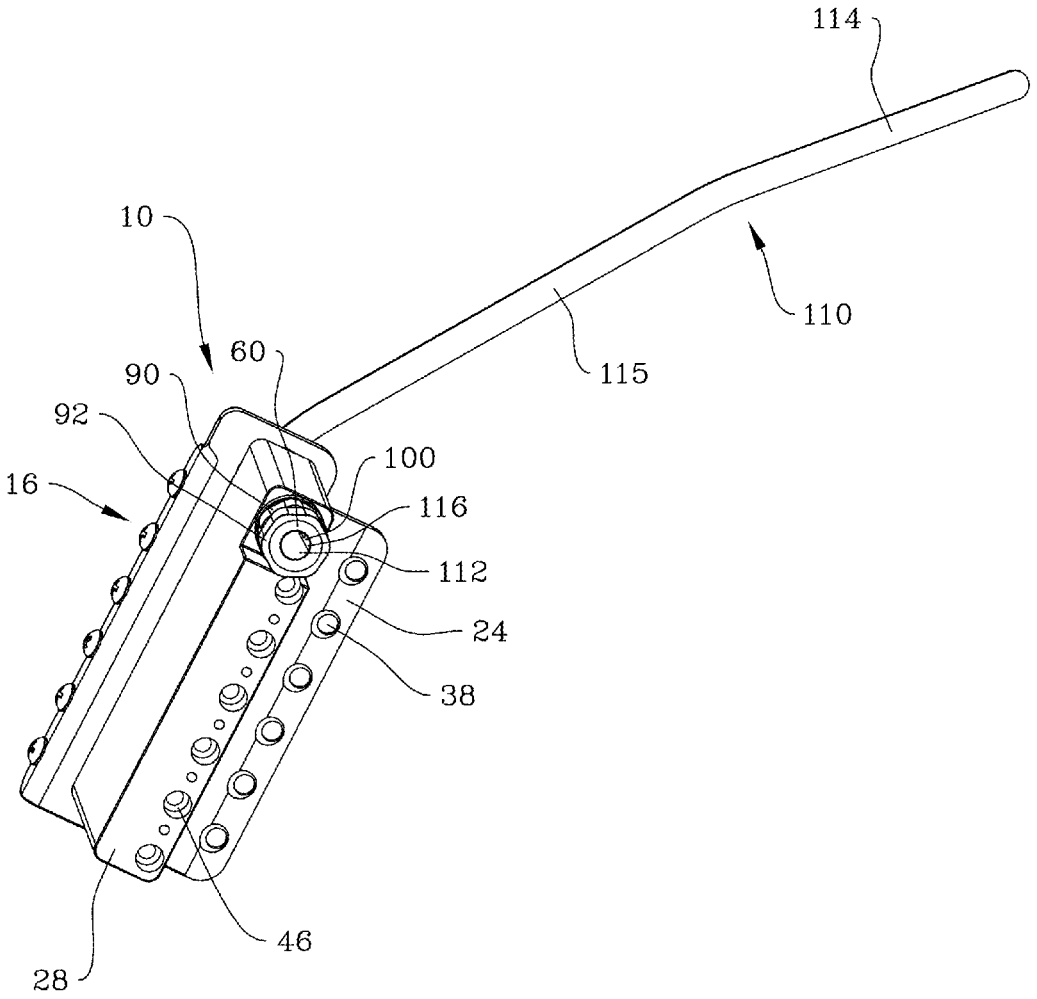
FIG. 3 is a bottom isometric view of the tremolo assembly of FIG. 2.
Figure 4:
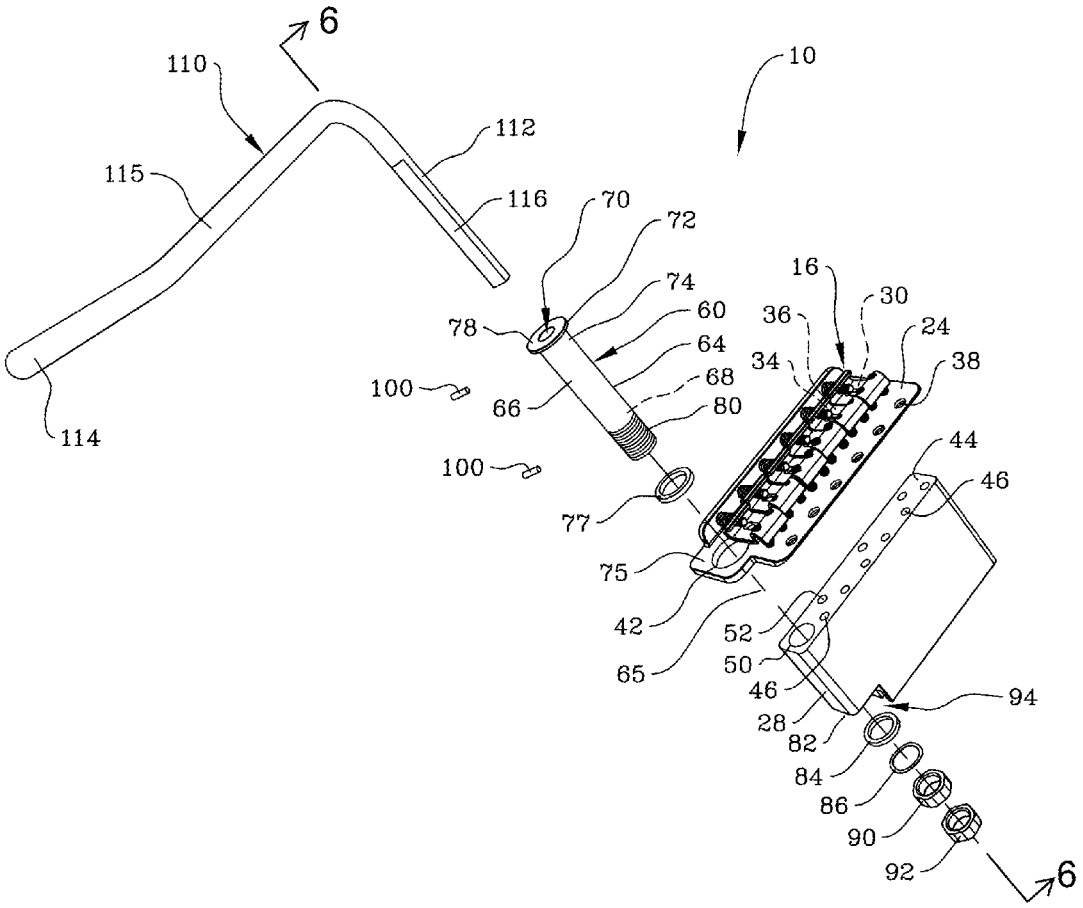
FIG. 4 is a partially exploded top isometric view of the tremolo assembly of FIG. 2.
Figure 5:
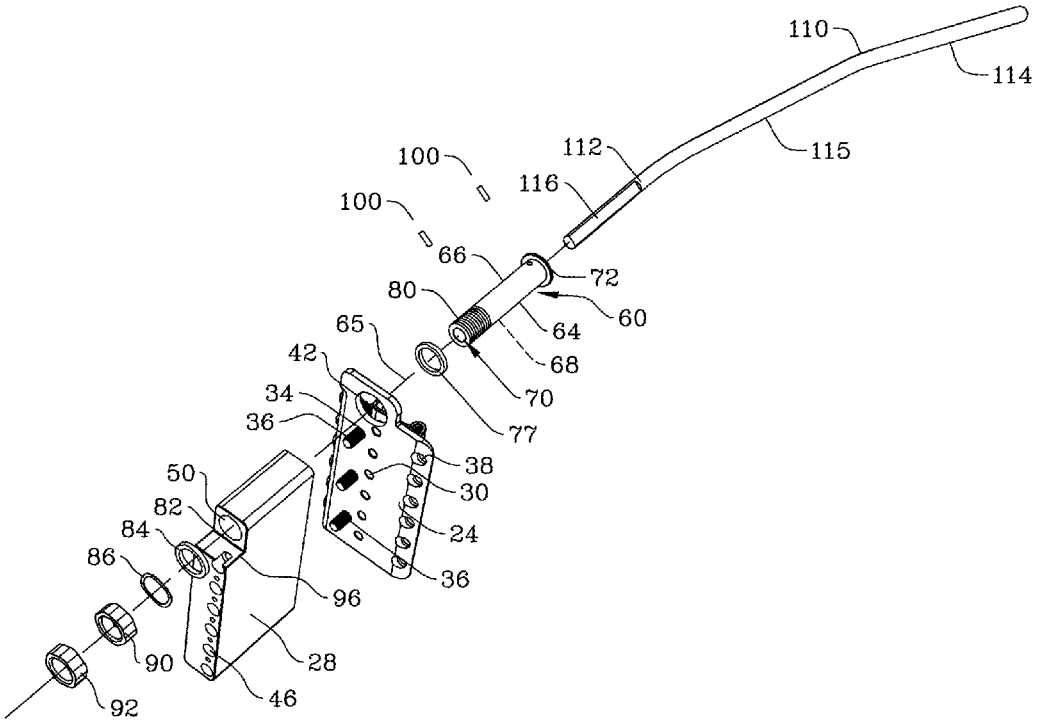
FIG. 5 is a partially exploded bottom isometric view of the tremolo assembly of FIG. 2.

FIG. 2 is an enlarged top isometric view of the tremolo assembly 10 shown removed from the guitar 12 (FIG. 1). FIG. 3 is a bottom isometric view of the tremolo assembly 10. FIG. 4 is a partially exploded top isometric view of the tremolo assembly 10, and FIG. 5 is a partially exploded bottom isometric view of the tremolo assembly 10. The saddle plate 24 of the illustrated embodiment has a set of string apertures 30, and the conventional saddle assemblies 16 are mounted over the string apertures 30. The saddle plate 24 has fastening apertures 34 that receive fasteners 36 (FIG. 5) that mount to the tremolo block 28. Mounting aperture 38 receive fasteners 40 (FIG. 1) to mount to the guitar body 14 (FIG. 1), and a tremolo aperture 42 through which a portion of a tremolo bushing 60 extends.

The tremolo block 28 of the illustrated embodiment is a block of metal, such as steel, titanium, alloy, or suitable material. The tremolo block of other embodiments can be other materials with suitable strength and acoustic properties. The tremolo block 28 has a flat top surface 44 that engages and supports the saddle plate 24. The tremolo block 28 has a plurality of string apertures 46 coaxially aligned with the string apertures 30 in the saddle plate 24. The tremolo block 28 also has a tremolo aperture 50 coaxially aligned with the tremolo aperture 42 in the saddle plate 24. The tremolo block 28 has fastener apertures 52 coaxially aligned with the fastening apertures 34 in the saddle plate 24. In the illustrated embodiment, three threaded fasteners 36 (e.g. screws) extend through the fastening apertures 34 in the saddle plate and screw into the fastener apertures 52 in the tremolo block 28. The fasteners 36 secure the saddle plate 24 in fixed engagement with the flat top surface 44 of the tremolo block 28. The tremolo block 28 and the string apertures 46 are configured so the strings 18 (FIG. 1) extend through block and through the string apertures 30 in the saddle plate, while the distal ends of the guitar strings are anchored in or on the bottom portion of the tremolo block.

The tremolo assembly 10 has a bushing 60 rotatably mounted in the aligned tremolo apertures 42 and 50 of the saddle plate 24 and tremolo block, respectively. The bushing 60 of the illustrated embodiment is a hollow, substantially cylindrical member with sidewalls 64 having a smooth exterior surface 66 and a smooth interior surface 68 that defines an interior bore 70 coaxially aligned with the bushing's longitudinal axis 65. The bushing 60 has a flange 72 extending radially from the bushing's upper end 74 and configured to be rotatably received in the saddle plate's tremolo aperture 42. In the illustrated embodiment, the upper surface 75 of the saddle plate 24 is substantially flush or coplanar with bushing's flange 72. The tremolo aperture 42 has a diameter slightly larger than the outer diameter of the flange 72 so the bushing will fit closely in the saddle plate 24 while still being able to freely rotate (as discussed in greater detail below). The illustrated embodiment also has a Teflon washer 77 on the upper portion of the bushing just under the flange 72, so the Teflon washer 77 is sandwiched between the flange 72 and the tremolo block 28. The Teflon washer 77 allows the bushing 60 and the flange 72 to rotate in the saddle plate 24 relative to the tremolo block. Although the illustrated embodiment has a washer made of Teflon, other lubricious material can be used. In other embodiments, the washer need not be used. The flange 72 and/or the tremolo block 28 can include a lubricious coating if needed to facilitate free rotation of the bushing relative to the saddle plate 24. In the illustrated embodiment, the saddle plate 24 has a thickness substantially equal to the thickness of the flange 72 and the washer 77, so the upper surface 78 of the flange 72 is substantially coplanar (i.e., flush) with the surface 75 of the saddle plate 24. While flange 72 in the illustrated embodiment is recessed within the saddle plate 24, the flange need not be recessed in all embodiments. In an alternate embodiment, the saddle plate 24 and the bushing 60 can be configured so the saddle plate is sandwiched between the bushing's flange 72 and the upper surface of the tremolo block.

In the illustrated embodiment, the bushing 60 is rotatably carried by the tremolo block 28 within the tremolo aperture 50. The outer diameter of the bushing's sidewalls 64 is slightly smaller than the inner diameter of the block's tremolo aperture 50. Accordingly, the bushing 60 can freely rotate within the tremolo block 28, but is substantially prevented from moving laterally within the block.

The bushing 60 of the illustrated embodiment has a threaded bottom end 80 opposite the flange 72. The bushing 60 extends through the entire tremolo block, and the bushing's threaded bottom end 80 extends past the bottom portion 82 of the tremolo block 28.

The tremolo assembly 10 has a Teflon washer 84 positioned on the threaded bottom end 80 of the bushing 60 and in direct engagement with the bottom portion 82 of the tremolo block 28. Although, the illustrated embodiment uses a washer made of Teflon, other embodiments can use other materials that are suitably lubricious to allow the bushing to freely rotate within the bushing. A spring washer 86 is positioned on the threaded bottom end 80 of the bushing 60 next to the Teflon washer 84, with the Teflon washer sandwiched between the tremolo block 28 and the spring washer 86. Two locking nuts 90 and 92 are screwed onto the threaded bottom end 80 of the bushing 60 immediately next to each other, with the spring washer 86 sandwiched between the upper most nut 90 and the Teflon washer 84. The upper nut 90 is screwed onto the bushing's threaded bottom end 80 so as to slightly compress the spring washer 86 against the Teflon washer 84, so that the bushing 60 is held firmly within the tremolo block 28 and substantially restricted from moving axially within the tremolo aperture 50. The upper nut 90, however, is tightened only enough to hold the bushing 60 in place while still allowing the bushing to substantially freely rotate. The lower locking nut 92 is tightened firmly against the upper locking nut 90 so as to secure the upper nut in a fixed position on the bushing, thereby forming a double nut locking system to securely hold the bushing in position in the tremolo block while insuring the bushing can rotate within the block 28.

In the illustrated embodiment, the Teflon washer 84 is immediately adjacent to the bottom portion 82 of the tremolo block 28. In an alternate embodiment, the spring washer 86 is positioned on the threaded bottom end 80 of the bushing 60 immediately adjacent to or in engagement with the bottom portion 82 of the tremolo block 28. The Teflon washer 84 is sandwiched between the spring washer 86 and the upper most nut 90. Accordingly, the sequential order in this alternate embodiment is the tremolo block 28, the spring washer 86, the Teflon washer 84, the upper nut 90 and the lower locking nut 92. This alternate configuration can provide a different feel to the tremolo assembly, such as the feel of the tremolo arm and tremolo block movement, which may be preferred by some musicians.

Figure 6:
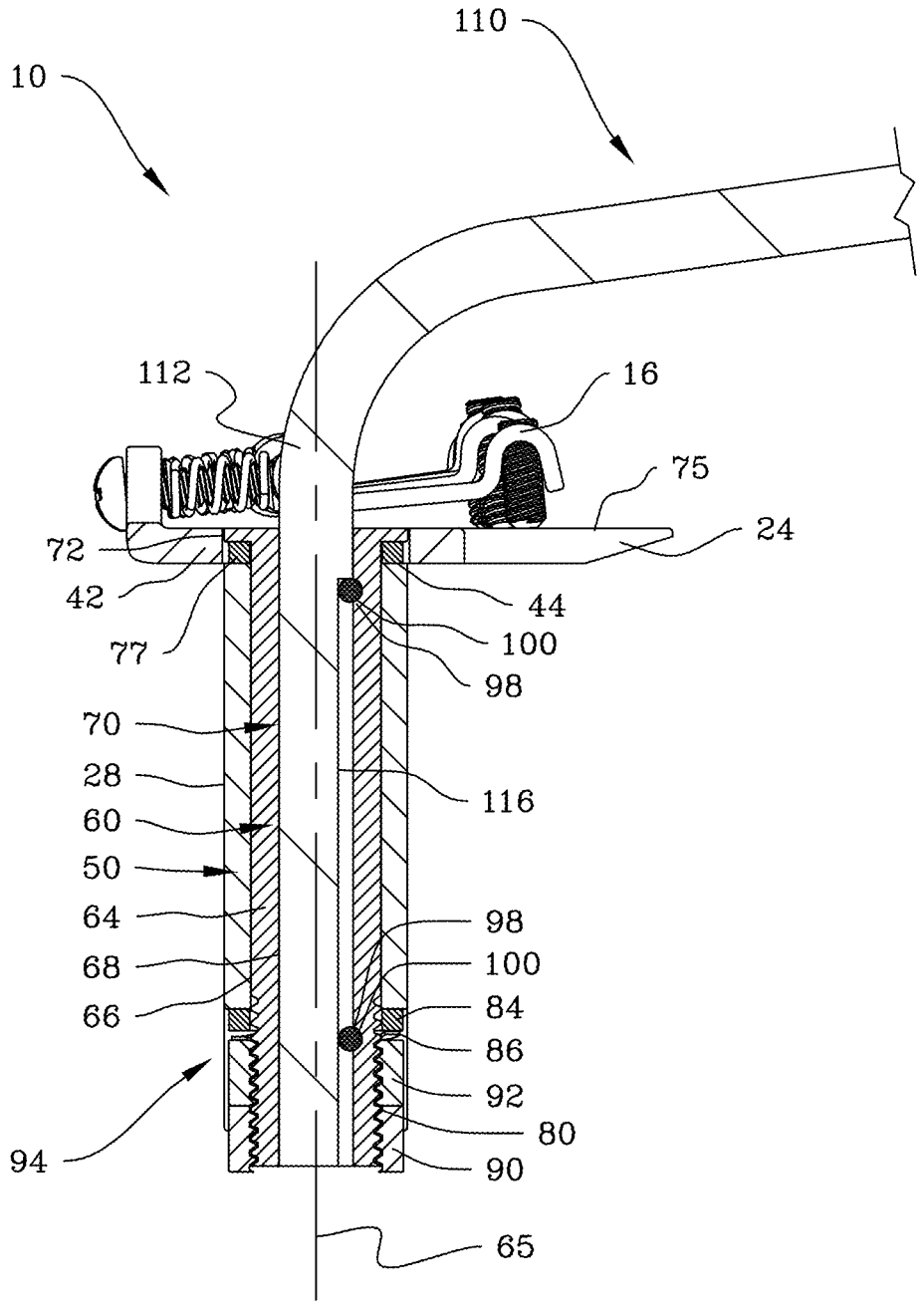
FIG. 6 is an enlarged cross-sectional view of the tremolo assembly taken substantially along line 6-6 of FIG. 4.
Figure 7:
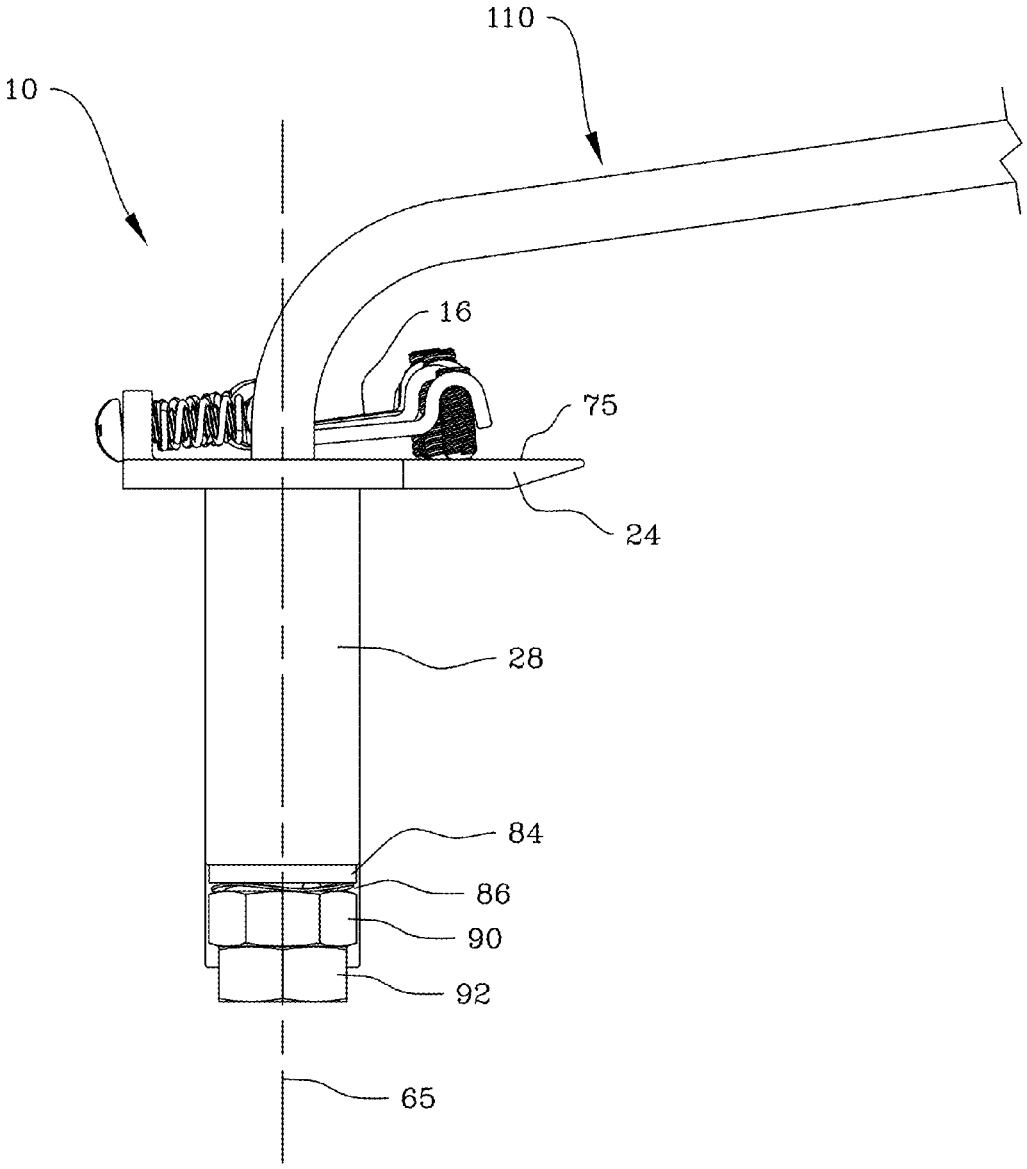
FIG. 7 is an enlarged partial side elevation view of the tremolo assembly of FIG. 2.

As seen in FIGS. 4-6, the bottom portion 82 of the tremolo block 28 adjacent to the tremolo aperture 50 has a recessed portion 94 sized and positioned to receive the washers 84 and 86 and the locking nuts 90 and 92. Accordingly, the washers and locking nuts are at least partially recessed relative to the end of the tremolo block. The bushing 60 and the recessed portion 94 of the illustrated embodiment are sized so the bushing's threaded bottom end 80 and the locking nuts 90 and 92 are approximately coplanar with the bushing bottom portion. Accordingly, the tremolo block 28, the bushing 60 and the locking nuts 90 and 92 are recessed within the body of the guitar 12 (FIG. 1), and do not stick out past the back surface of the guitar body 14 (FIG. 1). In other embodiments, however, the tremolo block 28, the bushing 60 and the locking nuts 90 and 92 can be other sizes as desired.

Figure 8:
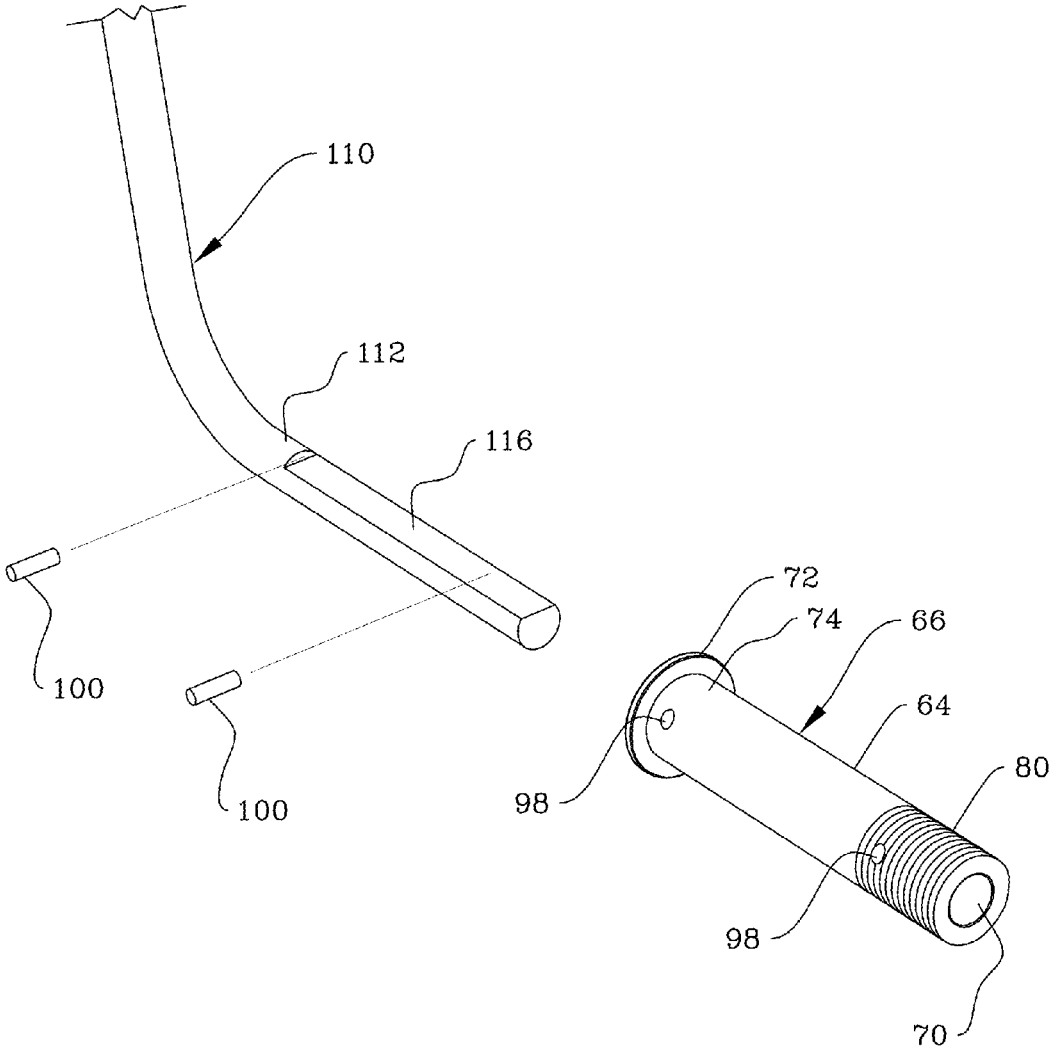
FIGS. 8 and 9 are partially exploded isometric views of a tremolo arm, bushing and engagement pins shown removed from the remainder of the tremolo assembly of FIG. 6.
Figure 9:
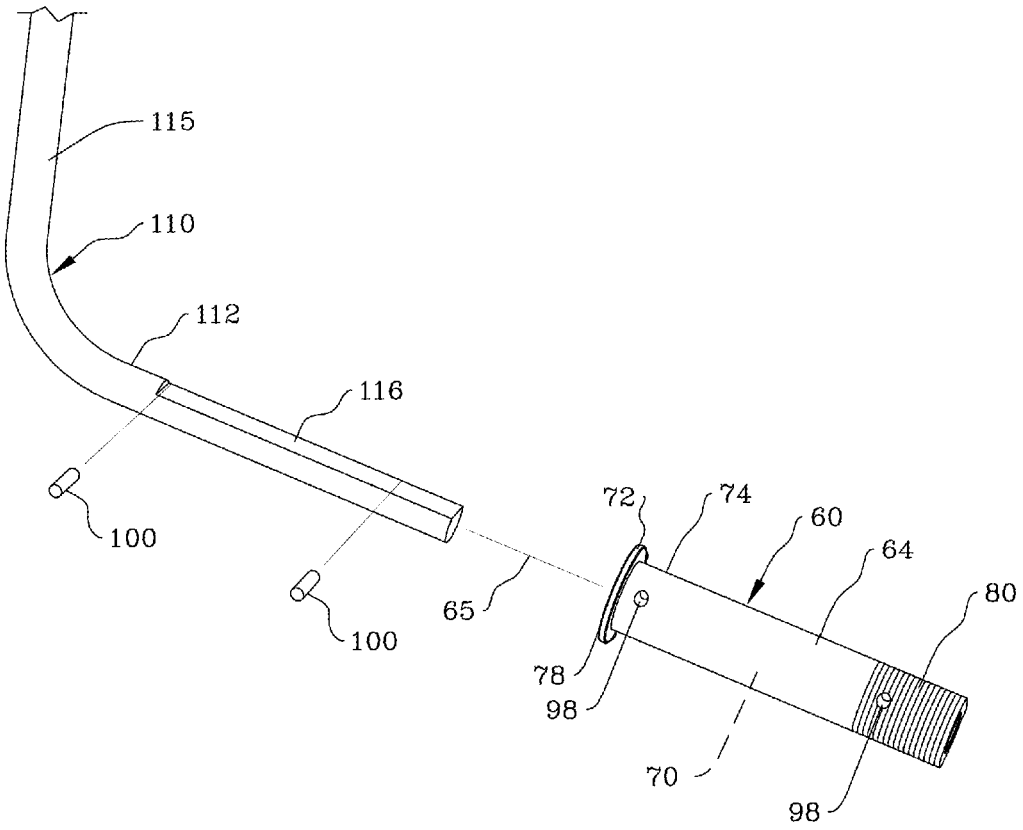
Figure 10:
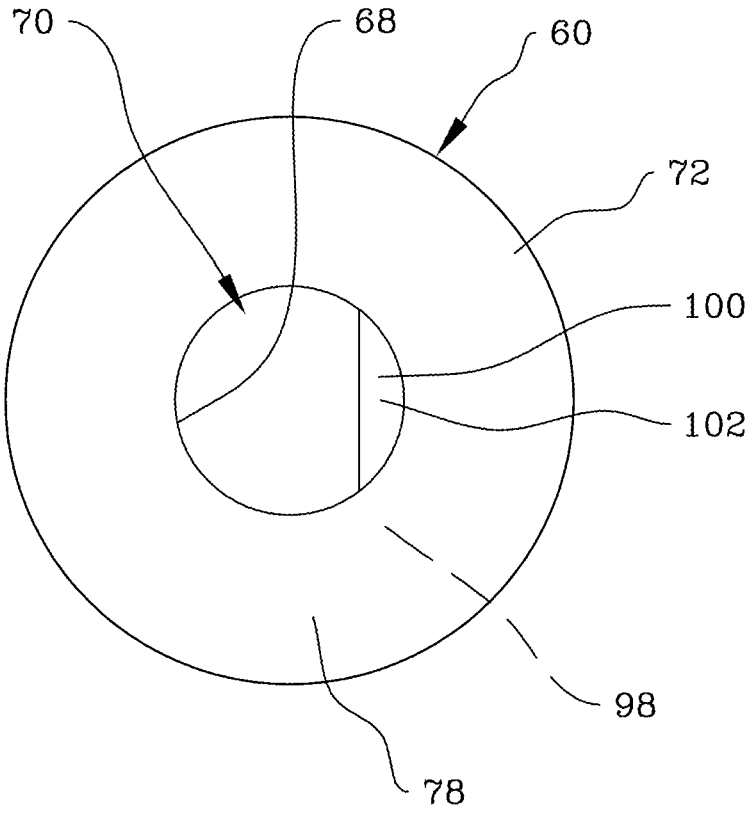
FIG. 10 is a top plan view of the bushing and engagement pins separated from the remainder of the tremolo assembly of FIG. 6.
Figure 11:
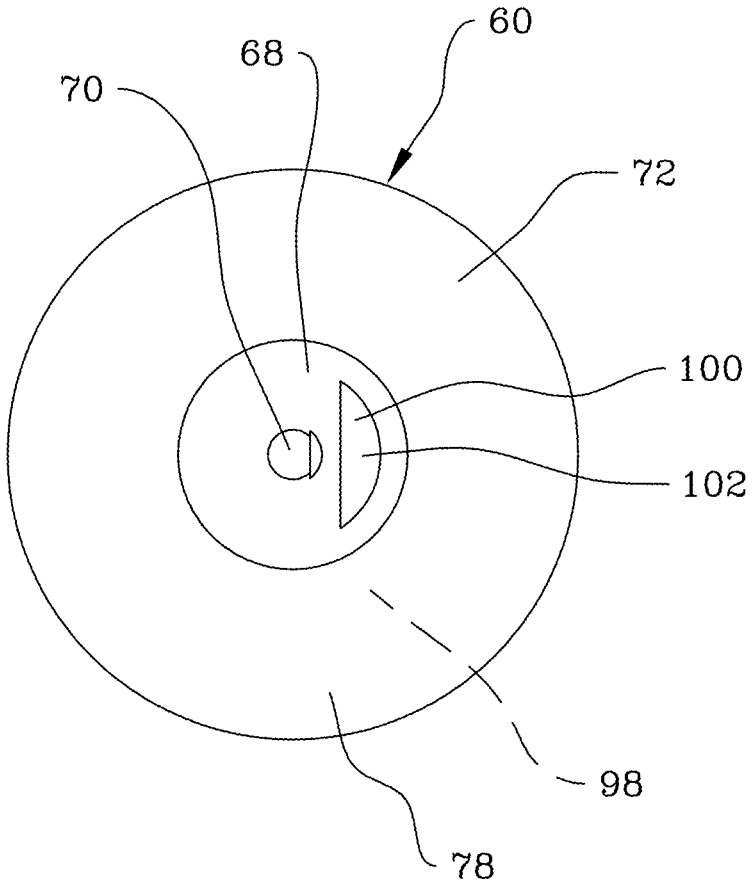
FIG. 11 is a top perspective of the view of the bushing and engagement pins of FIG. 10.
Figure 12:
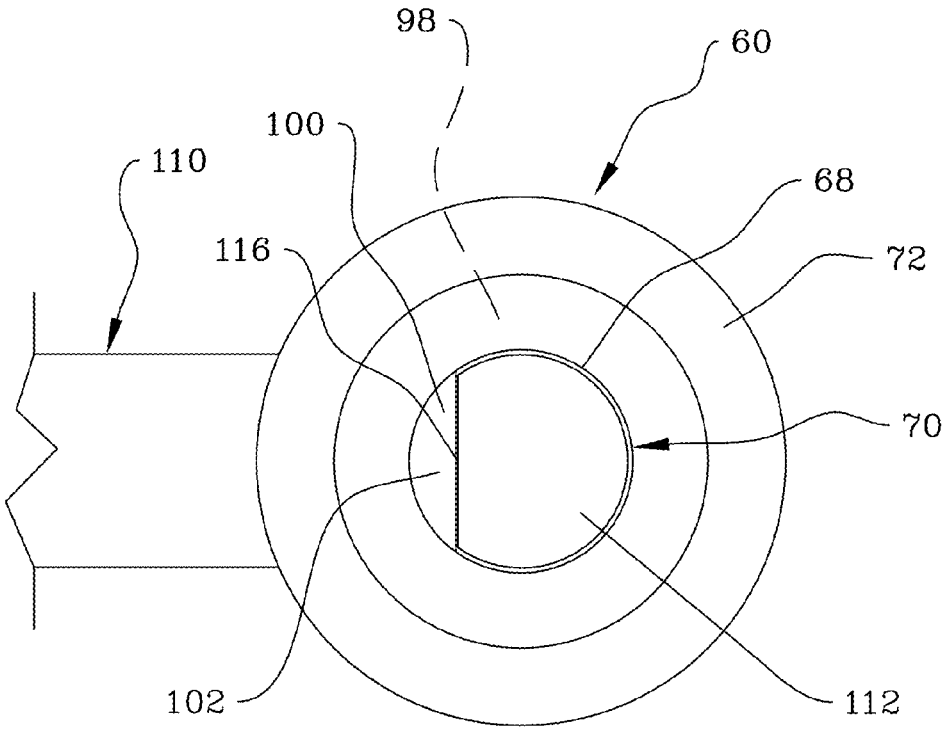
FIG. 12 is a bottom perspective of the view of the bushing and engagement pins of FIG. 11 with the tremolo arm shown installed in the bushing.

As best seen in FIGS. 6, 8 and 9, the bushing 60 has a pair of pin apertures 98 extending through the sidewalls 64. The pin apertures 98 of the illustrated embodiment are spaced apart and parallel to each other, and the apertures are substantially transverse perpendicular) to the longitudinal axis 65 of the bushing 60. In addition, the pin apertures are laterally disposed from the bushing's longitudinal axis, while still extending across a side portion of the bushing's interior bore 70. As seen in FIGS. 10-12, the engagement pins 100 are positioned in the pin apertures 98, such that middle portions 102 of the pins extend across the side portion of the bushing's interior bore 70. The engagement pins 100 are fixed within the pin apertures 98 so they are prevented from being removed without the use of a tool for removal. In one embodiment, the engagement pins 100 are secured in place via a friction fit within the pin apertures. In other embodiments, an adhesive or other bonding material can be used to hold the engagement pins 100 in place. In yet another embodiment, the engagement pins 100 are threaded set screws, and the pin apertures 98 are threaded to receive the pins. Other embodiments can use other techniques for retaining the engagement pins in place.

As best seen in FIGS. 4, 5, 8, and 9, the tremolo assembly 10 has a tremolo arm 110 that is removably received in the interior bore 70 of the bushing 60. The tremolo arm 110 of the illustrated embodiment has an engagement section 112 that snugly fits into the bushing's interior bore 70, a handle 114 opposite the engagement section 112, and a contoured intermediate section 115 extending therebetween.

In the illustrated embodiment, the engagement section 112 has a partially cylindrical shape with a flattened engagement surface 116. This flattened engagement surface 116 works with the pins 100 in the bushing 60 to act as a keyway arrangement. In an alternate embodiment, the bushing 60 and the engagement section 112 of the tremolo arm 110 can be configured with a keyway having other shapes or configurations while controlling the orientation of the tremolo arm 110 relative to the bushing when the tremolo arm is installed into the bushing. When the tremolo arm 110 is installed into the bushing as shown in FIG. 12, the engagement surface 116 is rotatably oriented to be parallel with the longitudinal axes of the pins 100. Accordingly, the engagement section 112 is not blocked by the pins 100 from extending fully into the interior bore 70. If the tremolo arm 110 is not oriented with the engagement surface 116 parallel to the pins 100, the pins block the engagement section from sliding fully into the interior bore. When the tremolo arm 110 is properly oriented, the engagement section 116 can be smoothly moved axially into and out of the bushing 60.

The tremolo arm's engagement section 112 is sized to closely fit within the interior bore 70, so the engagement surface 116 is in firm engagement with the pins and the rest of the engagement section that contacts the bushing's smooth interior surface 68. Accordingly, the tremolo arm is held in the bushing via a friction fit between the bore's interior surface 68 and the pins 100. The friction fit is tight enough to allow the tremolo arm 110 to be easily pushed into the bushing 60 and retained in place while actively playing the guitar. The friction fit, however, is not so tight as to require excess force or separate tools to install or remove the tremolo arm 110 from the bushing 60.

When the tremolo arm 110 is installed in the bushing, the engagement section 112 and the bushing are rotatable as a unit relative to the tremolo block 28. Accordingly, the tremolo arm 110 can be rotated with the bushing 60 relative to the block 28 and the guitar body 14 so the handle 114 is easily and quickly moveable between a lowered, inactive position, as shown in FIG. 13, and a raised, active or playing position, as shown in FIG. 1. In the illustrated embodiment, the tremolo arm 110 and the bushing 60 are configured to allow the musician playing the guitar 12 to quickly grab the tremolo arm's handle when in the lowered, inactive position and rotate it to the raised playing position. When the musician is finished (or temporarily finished) using the tremolo arm 110, he or she can let go of the handle 114 and the tremolo arm will rotate and drop back to the lowered, inactive position. As indicated above, the bushing 60 and the locking nuts 90 and 92 can be adjusted to control the amount of resistance on the bushing, thereby controlling the force needed to move the tremolo arm between the lowered, inactive position and the raised, playing position.

The tremolo arm 110 is contoured along the intermediate section 115 and the handle 114 so the handle is in a convenient and easy position for the musician to grab and manipulate relative to the guitar. For example, when the tremolo arm 110 is installed and in the raised, playing position (FIG. 1), the musician can hold the handle 114 and move the tremolo arm 110 relative to the guitar body 14, thereby causing bushing 60, the tremolo block 28 and the saddle plate 24 to pivot as a unit about the fasteners 40 that secure the saddle plate 24 to the guitar body 14. This pivoting motion causes the end of the saddle plate 24 with the string apertures 30 to move relative to the guitar body 14, thereby changing the tension of the guitar strings 18, which changes the pitch of the strings. Accordingly, the tremolo arm 110 creates a long lever arm that the musician can use to easily, quickly, and precisely pivot the tremolo assembly 10 to change the pitch of the strings when playing the instrument as to create a vibrato. In the illustrated embodiment, the tremolo arm's engagement section 112 and the bushing 60 are sized to provide a longer and more stable lever arm to cause the pivoting motion of the saddle plate 24, thereby providing better control and accuracy for the musician for creating the vibrato.

The tremolo assembly 10 of the present invention maintains a secure fit and it avoids the drawbacks of a loose or sloppy fit that can be experienced over time with a threaded engagement between components of a tremolo system of the prior art. The tremolo assembly of the present invention also allows the tremolo arm to be quickly and easily installed without having to wind the arm around and around as needed with the threaded systems of the prior art. Accordingly, the tremolo assembly 10 provides a superior tremolo system that resolves inefficiencies and other drawbacks of the prior art.

FIGS. 14-28 illustrate one or more alternate embodiments of a tremolo assembly 200 in accordance with aspects of the present disclosure. As shown in FIGS. 14-18, the tremolo assembly 200 is similar to the tremolo assembly 10 discussed above for use with the guitar 12 (FIG. 1). The tremolo assembly 200 includes the saddle plate 24 and the saddle assemblies 26 that mount to a tremolo block 202. The tremolo assembly 200 also includes the apertures 34, 38, 42 (FIG. 4) and fasteners 36 and 40 (FIG. 1) of the embodiments discussed above. Further, the tremolo assembly 200 includes the tremolo bushing 60 with its washers, flanges, and locking nuts 90 and 92 all as discussed above. The tremolo assembly 200 receives the tremolo arm 110 in the same manner as discussed above. Accordingly, the features of the tremolo assembly 200 and the tremolo block 202 that substantively differ from the above embodiment discussed above will be discussed in greater detail below.

Figure 14:
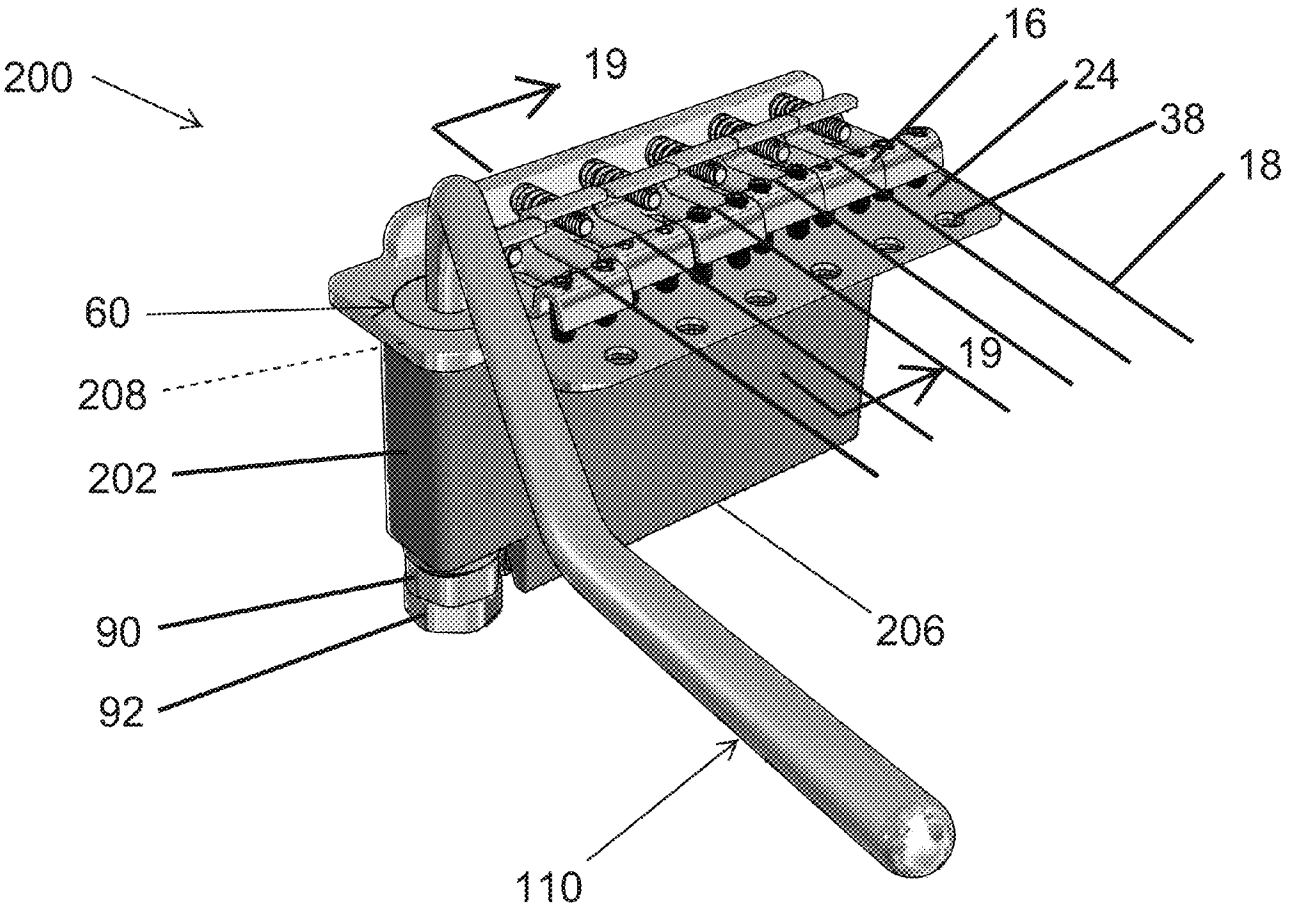
FIG. 14 is a front left perspective view of a tremolo assembly in accordance with another embodiment of the present disclosure.
Figure 15:
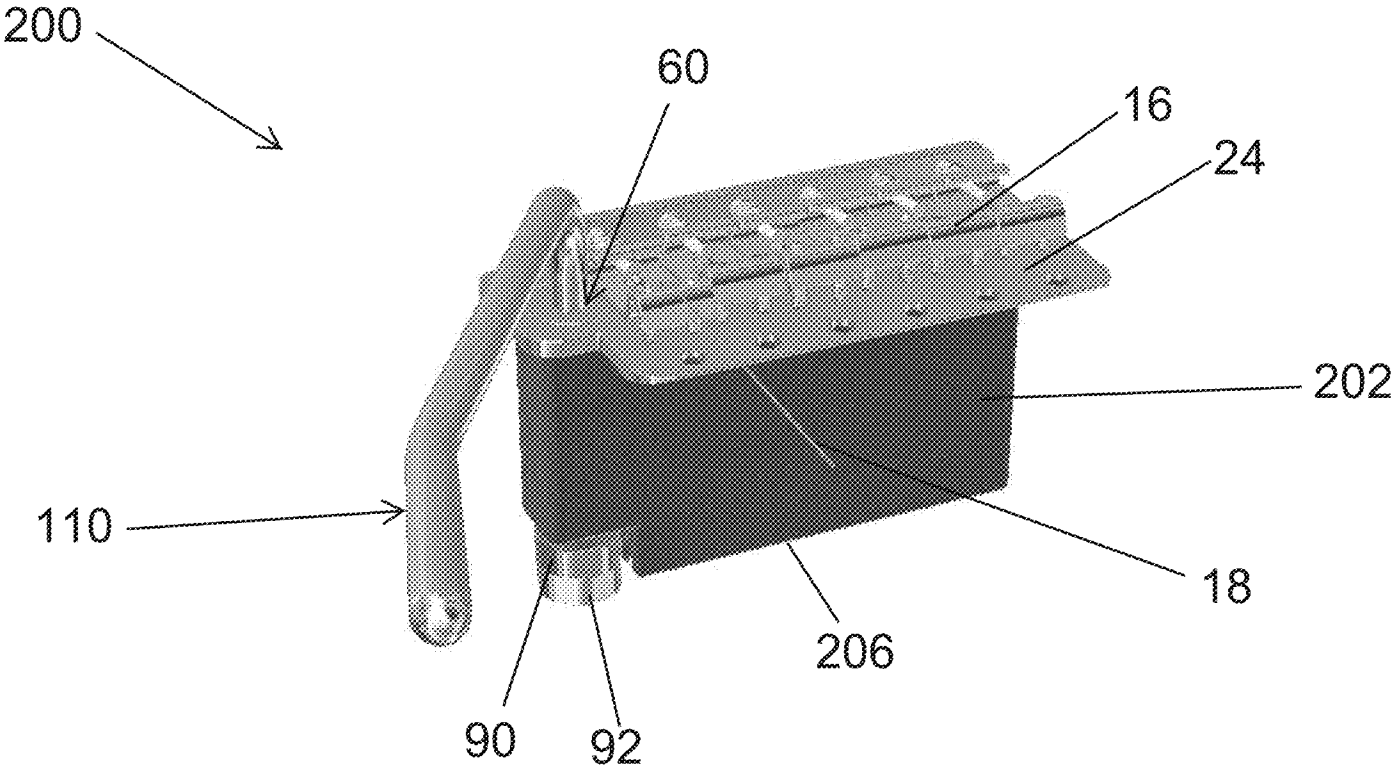
FIG. 15 is another perspective view of the tremolo assembly of FIG. 14.
Figure 16:
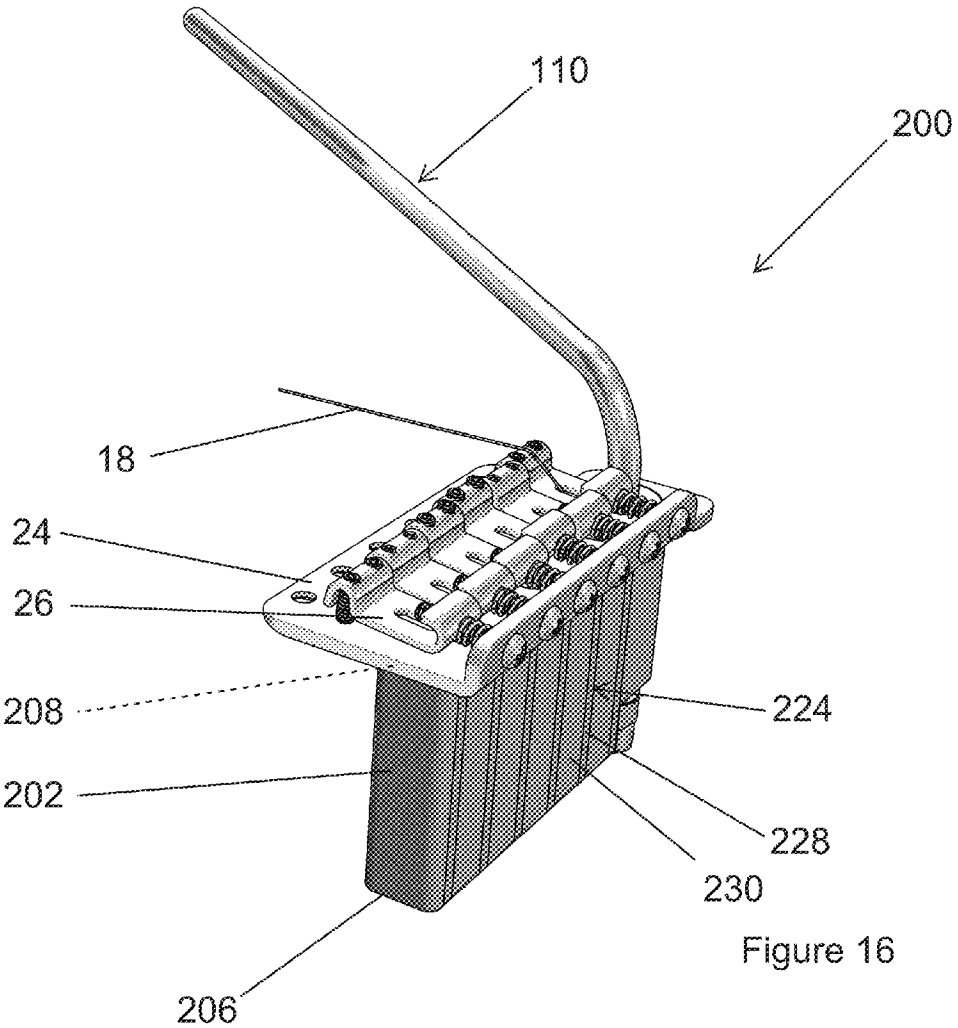
FIG. 16 is rear right perspective view of an embodiment of the tremolo assembly of FIG. 14.
Figure 17:
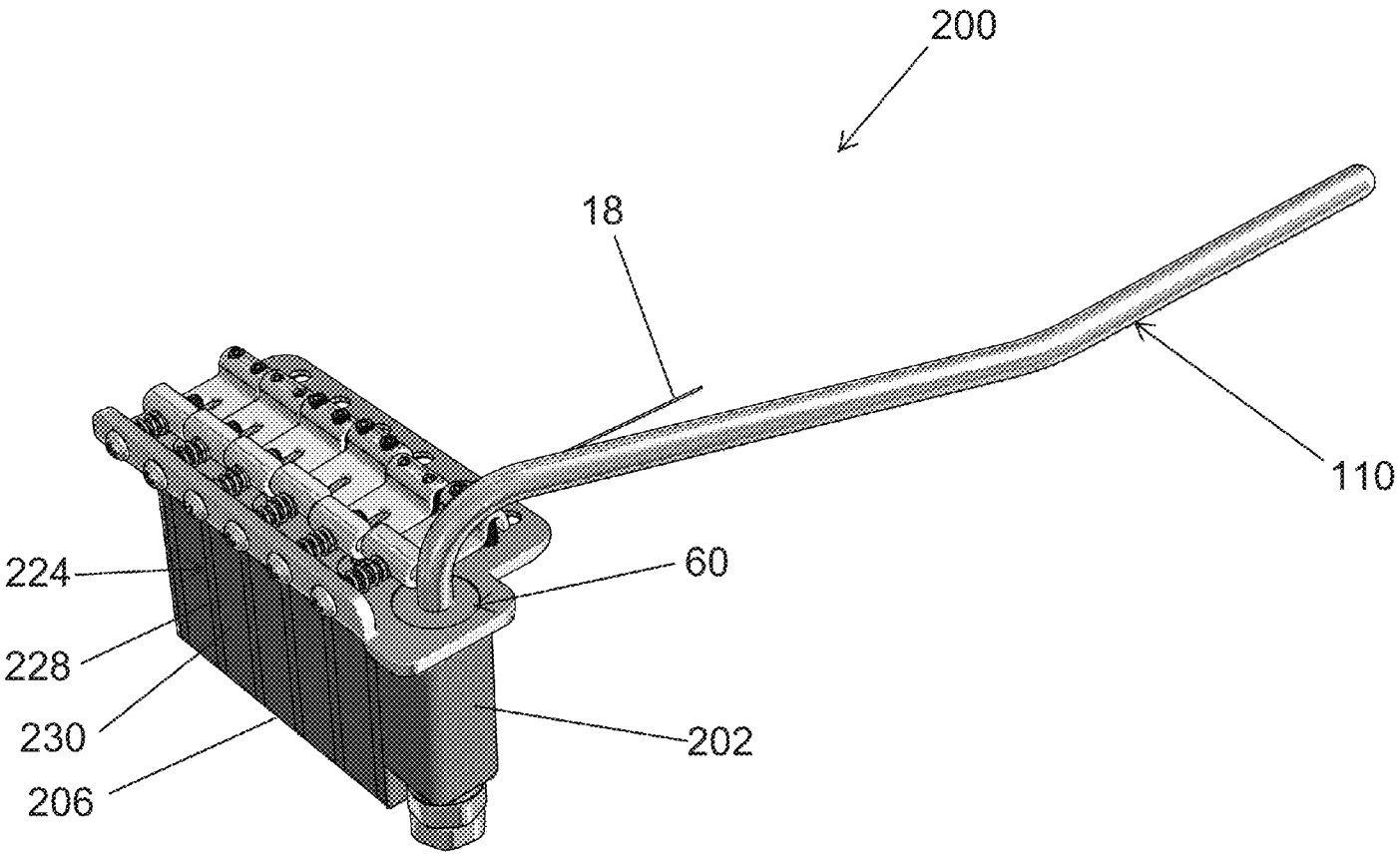
FIG. 17 is a rear left perspective view of the tremolo assembly of FIG. 16.
Figure 19:
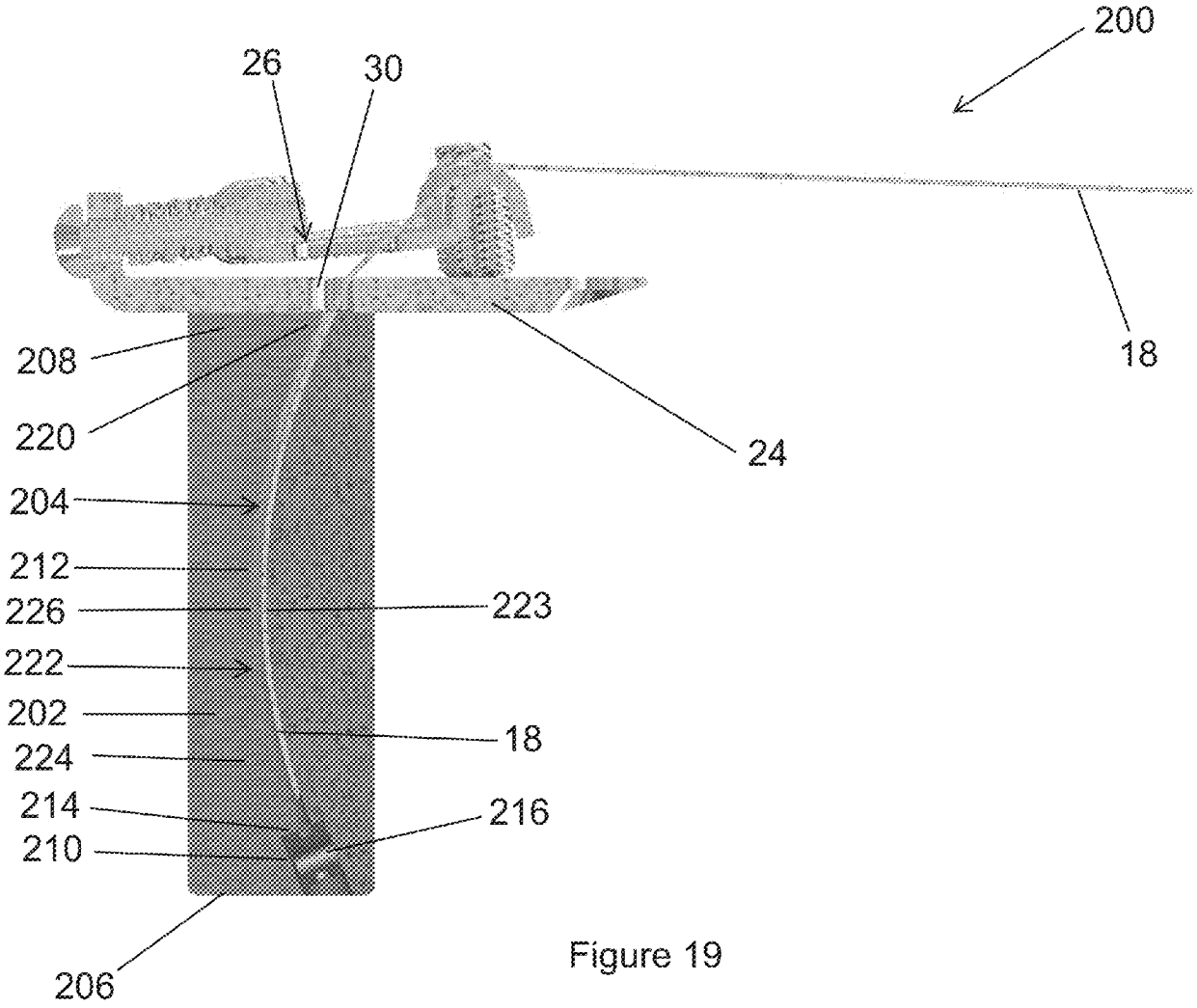
FIG. 19 is a cross-sectional view taken substantially along line 19-19 of FIG. 14.

FIG. 19 is a cross-sectional view taken substantially along lines 19-19 of FIG. 14, showing the interior of the tremolo block 202. The tremolo block is configured with an arcuate string aperture 204 extending from the bottom 206 of the tremolo block 202 to the top 208 of the tremolo block. This arcuate string aperture 204 is shaped and sized so the string 18 rests against and is in direct contact with the curved surface of the tremolo block 202 that defines at least a portion of the arcuate string aperture 204. In the illustrated embodiment, the string 18 directly engages the tremolo block along virtually the full length of the string aperture 204 above the ball end of the string. This full contact between the string 18 and the tremolo block 202 along the arcuate passageway allows the vibrating string to utilize the resonance of the tremolo block 202. This direct contact along the smooth arcuate surface of the tremolo block also results in a substantially cleaner sound and increased sustain of the string during vibration of the string 18.

Figure 18:
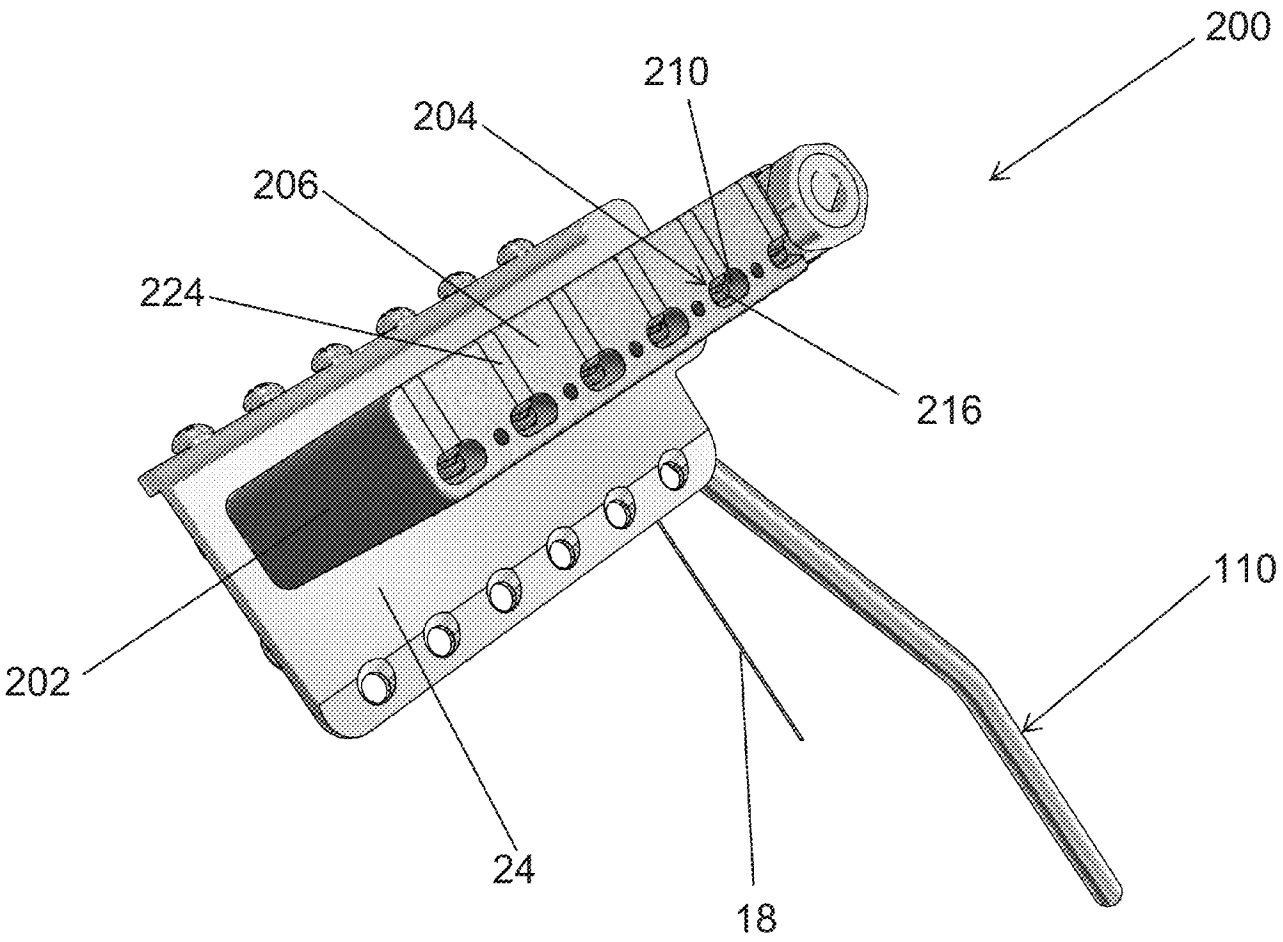
FIG. 18 is a bottom perspective view of the tremolo assembly of FIG. 17.
Figure 20:
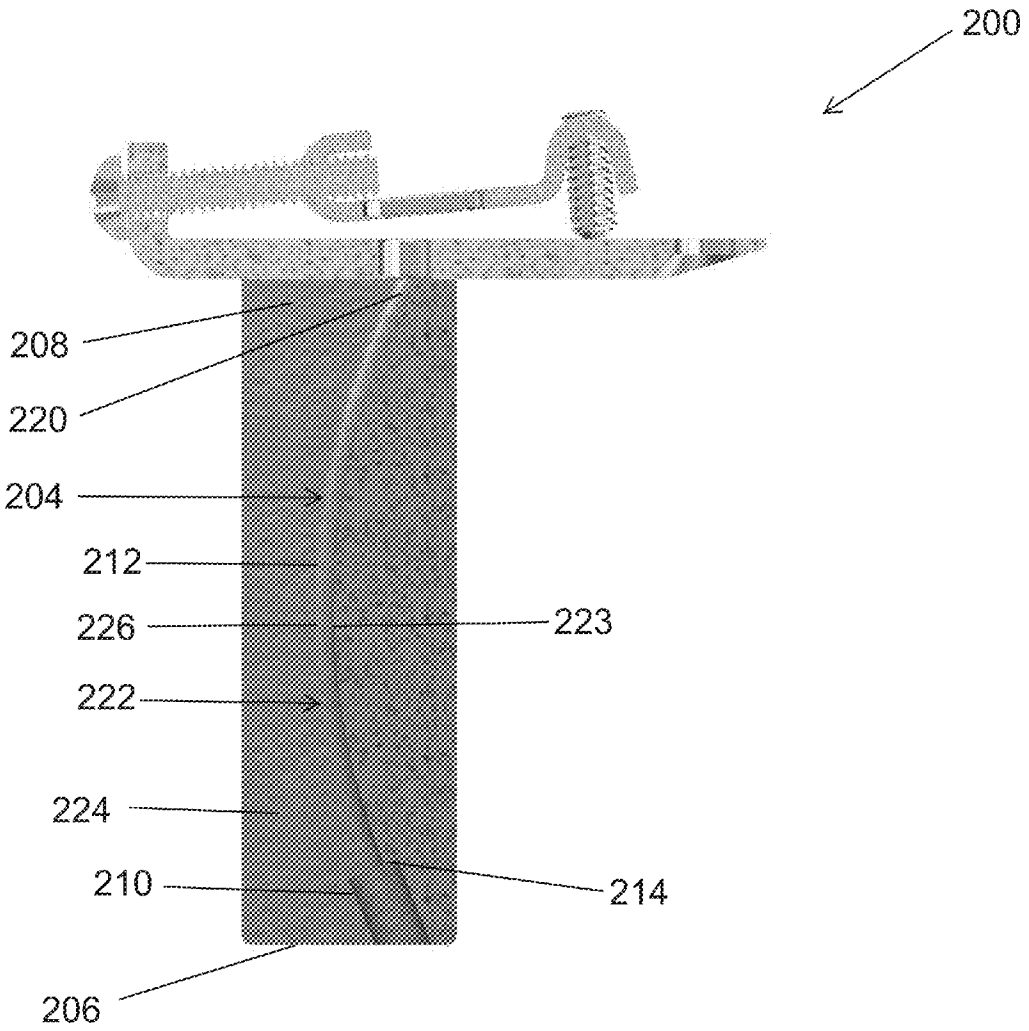
FIG. 20 is a cross-sectional view taken substantially along line 20-20 of FIG. 16.

As seen in FIGS. 19 and 20, the string aperture 204 has a short, enlarged bottom portion 210 connected to a smaller diameter string portion 212. The intersection between the bottom portion 210 and the narrower string portion 212 defines a shoulder 214. The bottom portion 210 of the string aperture 204 is shaped and sized to receive the ball end 216 of the string 18, such that the ball end 216 is held in firm engagement against the shoulder 214 when the string 18 is in tension. In the illustrated embodiment, as shown in FIG. 18, the bottom portion 210 of the string aperture 204 is generally elliptical, rather than having a circular cross-section. This generally elliptical shape is sized to receive the ball end 216 of the string 18 so as to prevent the ball end 216 from rotating within the string aperture 204. This arrangement of the string aperture 204 provides a greater surface contact area between the string's ball end 216 and the tremolo block 202, while also preventing rotation and/or movement of the end of the string 18 relative to the tremolo block, such as while employing the tremolo assembly to change pitch of the strings.

In the illustrated embodiment, the bottom portion 210 of the string aperture 204 is oriented at an angle of approximately 20°-30° relative to the bottom 206 of the tremolo block 202. In one embodiment, the bottom portion 210 of the string aperture 204 is oriented at an angle in the range of approximately 20°-24°, and preferably at approximately 22° relative to the bottom 206 of the tremolo block 202. Other embodiments can provide the bottom portion 210 of the string aperture 204 at a different angle while still achieving the desired contact between the string 18 and the curved convex surface of the tremolo block 202 in the string aperture 204.

The arcuate string portion 212 in the tremolo block 202 of the illustrated embodiment has a substantially constant radius that allows the string 18 to lay smoothly against the tremolo block from substantially the ball end 216 through the entire length of the string aperture's string portion 212 to the top 208 of the tremolo block, where the string exits the tremolo block 202 and enters the saddle plate 24. In the illustrated embodiment, the string portion 212 of the string aperture 204 has a diameter or width of approximately 0.100 inches, although other sizes can be used for the string aperture 204. Further, the string portion 212 of the string aperture 204 is configured in the tremolo block 202 with a substantially constant radius in the range of approximately 1.5 inches-2 inches. In the illustrated embodiment, the constant radius is approximately 1.675 inches, although other radii can be used for string apertures while maintaining the substantial full contact between the string and the aperture through the tremolo block 202. In other embodiments, the curved string aperture 204 may have a variable radius configuration.

Figure 21:
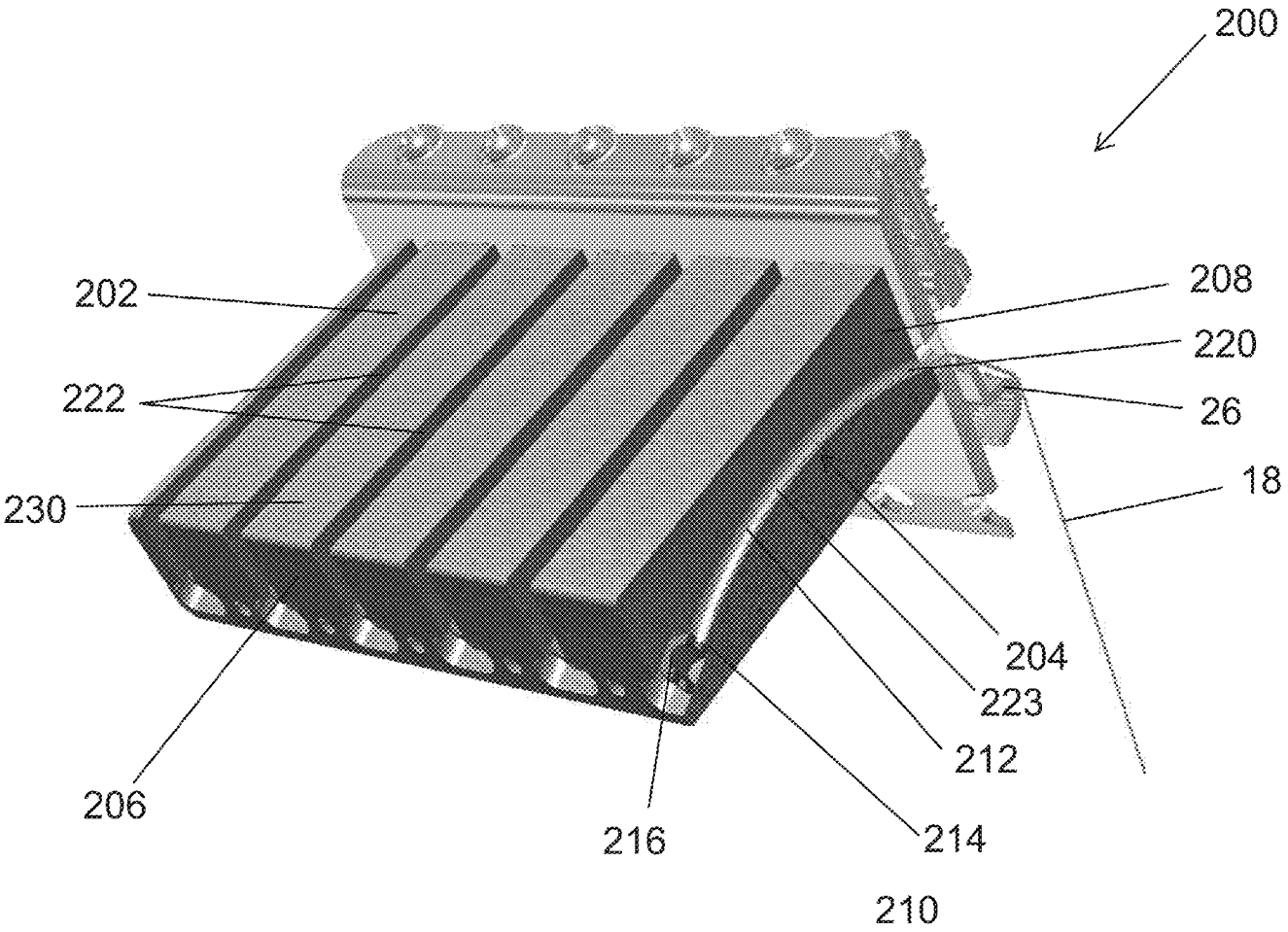
FIG. 21 is a partially cutaway perspective view of the tremolo assembly of FIG. 16.
Figure 22:
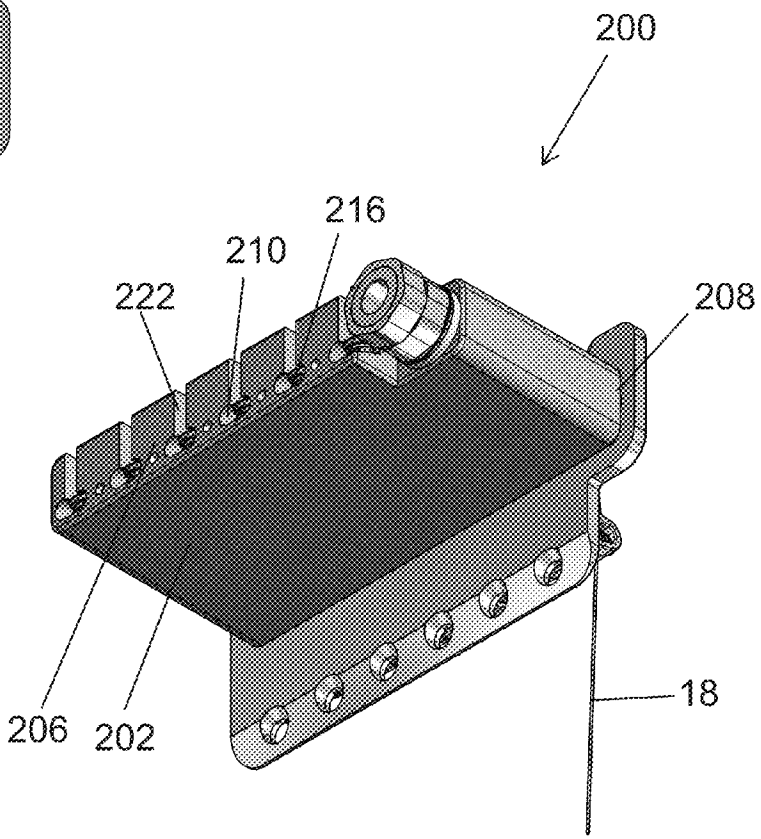
FIG. 22 is a partially bottom rear perspective view of the tremolo assembly of FIG. 16 with the tremolo arm removed for purposes of clarity.
Figure 23:
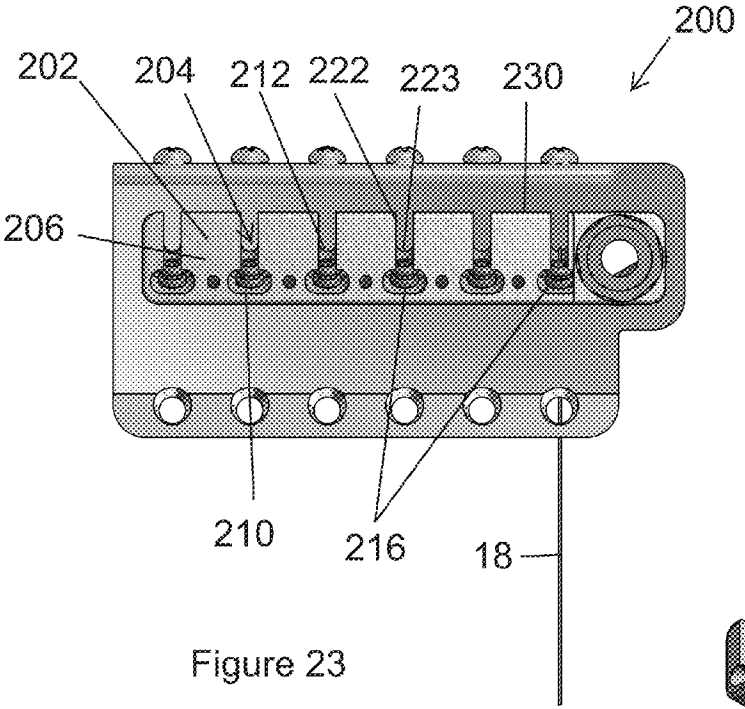
FIG. 23 is a bottom plan view of the tremolo assembly of FIG. 22.
Figure 24:
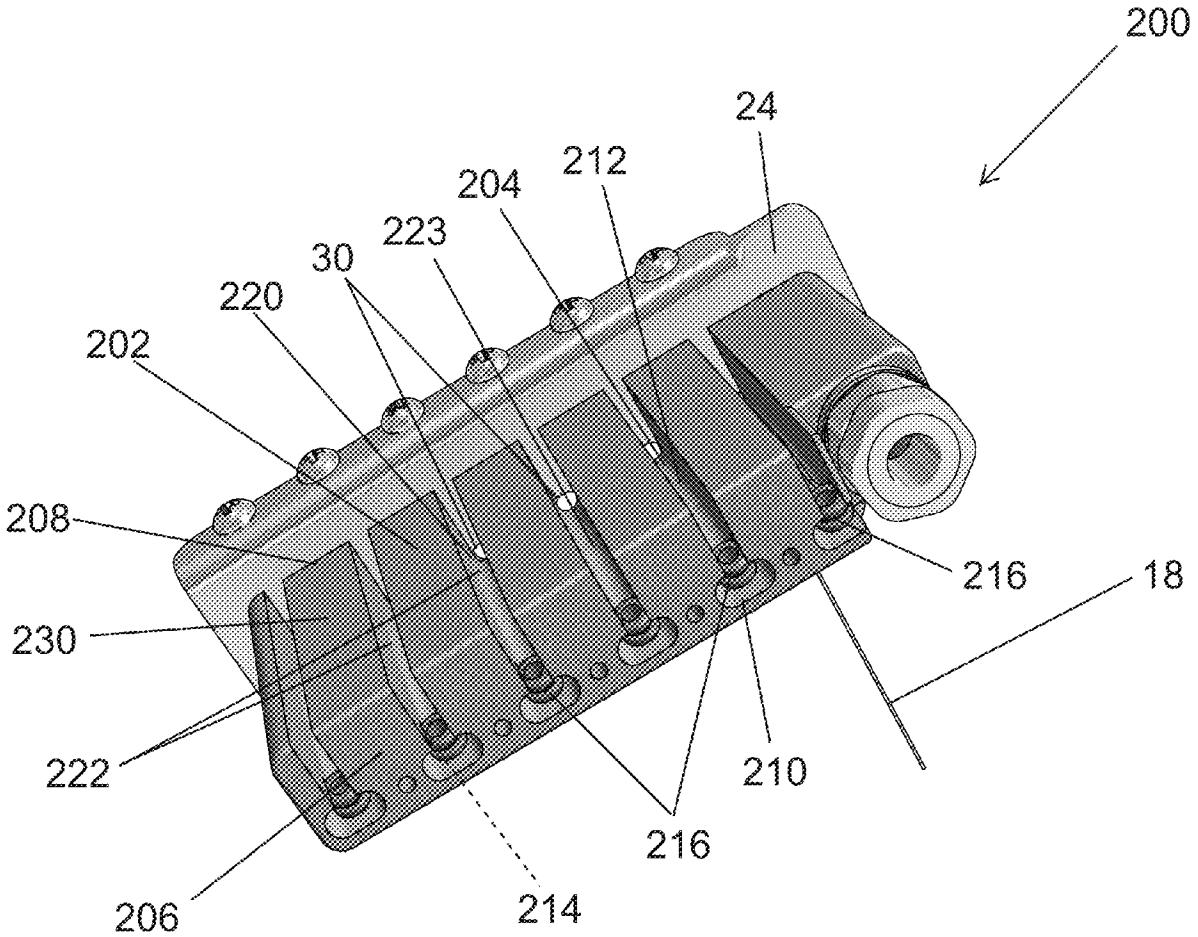
FIG. 24 is a bottom perspective view of the tremolo assembly of FIG. 22.

As seen in FIGS. 19 and 21, the upper end 220 of the string aperture 204 is positioned below the string apertures 30 in the saddle plate 24 to allow the string 18 to extend out of the tremolo block 202 through the saddle plate and on to the saddle assemblies 26 in a smooth continuous arc with a minimal amount of radius change, bending, and/or crimping of the string. In at least one embodiment, the tremolo assembly 200 is configured so the string 18 maintains a substantially constant radius as the string exits the string aperture 204 in the tremolo block 202, through the saddle plate 24, and over the saddle assemblies 26.

The tremolo block 202 of the illustrated embodiment can be a solid block with the arcuate string apertures 204 formed or otherwise machined therethrough. In one embodiment, the tremolo block 202 can be a cast component, although other forming or machining techniques can be used. The tremolo block of the illustrated embodiment is made of a low-carbon steel material. The tremolo block 202, however, in other embodiments can be made of other alloys or nonmetal materials suitable for acoustic applications. In yet another embodiment, as shown in FIGS. 21-26, the arcuate string apertures 204 can be defined by slots 222 machined or otherwise formed into the tremolo block 202, wherein the surface of each slot is a convex surface that defines the radius along one side of the string aperture 204. The other side of the string aperture 204 is formed or defined by an insert 224 (FIGS. 25 and 26) that fits securely within an outer portion of each slot 222 and that has a concave surface 226 spaced apart from the convex surface 223 on the bottom of the slot 222. The inserts 224 are positioned in the slots 222 with the concave surface 226 spaced apart from the convex surface 223 to define the passageway with a selected width or diameter through the tremolo block 202 through which the string 18 extends. The selected width or diameter of the string aperture 204 can be, for example, in the range of approximately 0.070 inches-0.200 inches. In the illustrated embodiment, the string aperture 204 has a width of approximately 0.100 inches, although other dimensions can be used. The inserts 224 are fixed in place with a back surface 228 flush against a back surface 230 of the tremolo block 202. The inserts 224 are fixedly secured in the tremolo block 202 with a friction fit, adhesive, and/or other suitable fastening means. This use of the inserts 224 can provide for easier manufacturing or cutting of the slots 222 while achieving the benefits of the arcuate string aperture 204.

Figure 25:
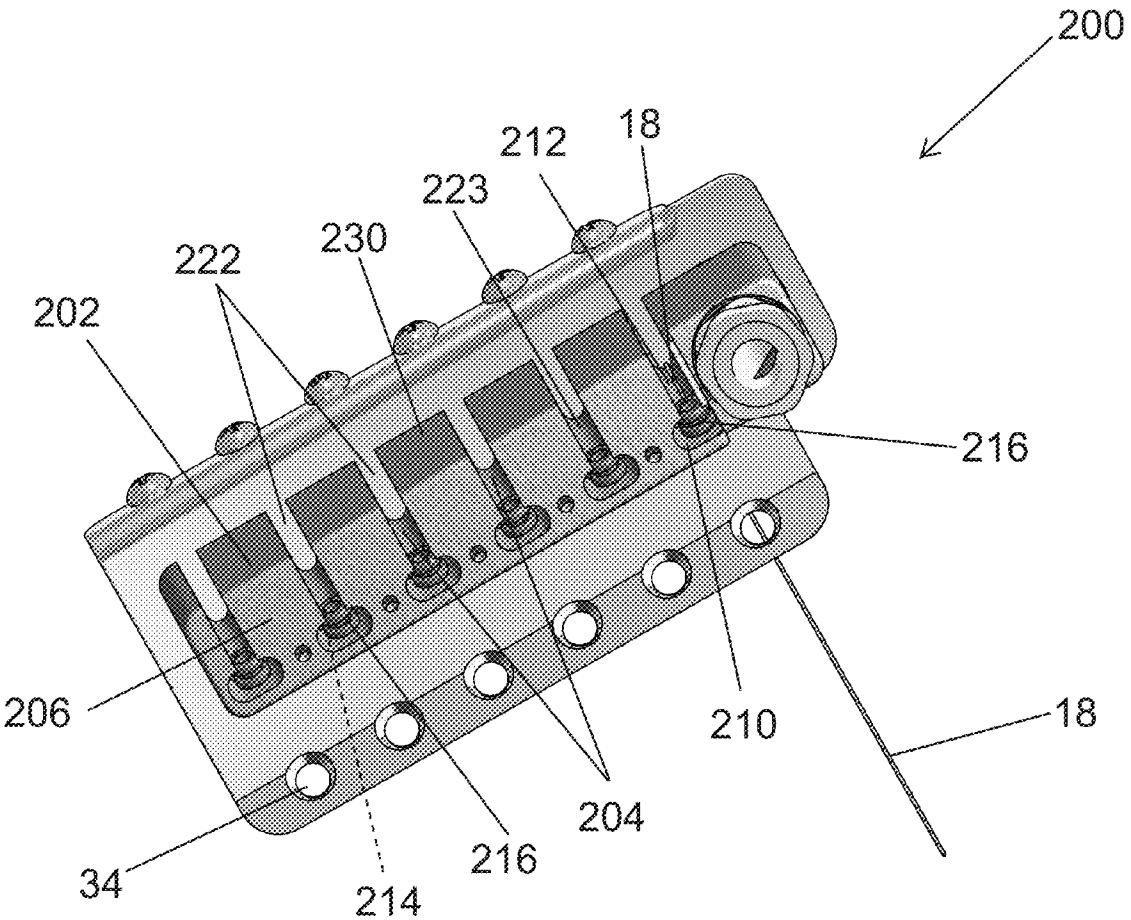
FIG. 25 is a bottom perspective view of the tremolo assembly of FIG. 16.
Figure 26:
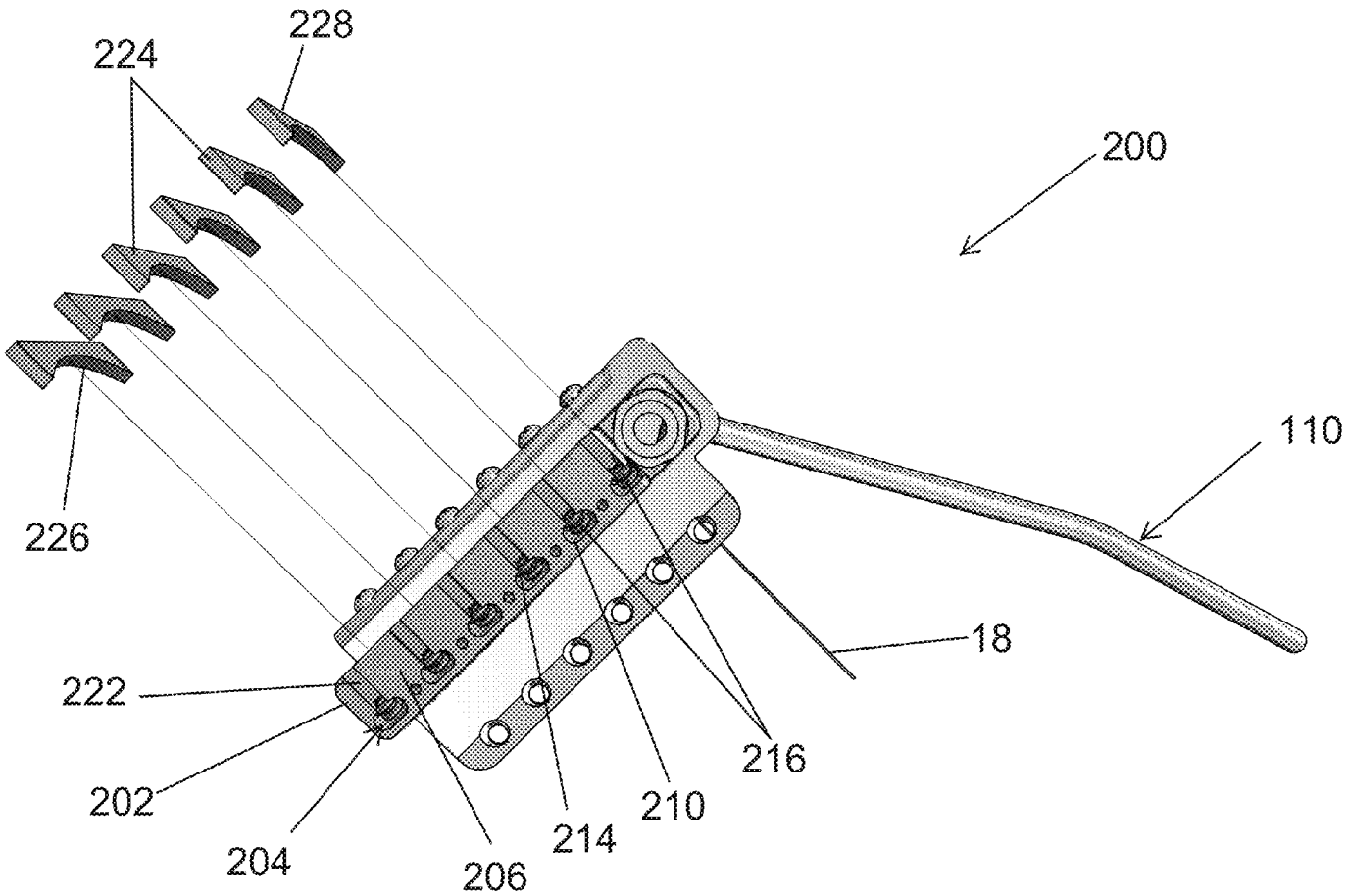
FIG. 26 is a partially exploded bottom perspective view of the tremolo assembly of FIG. 16.
Figure 27:
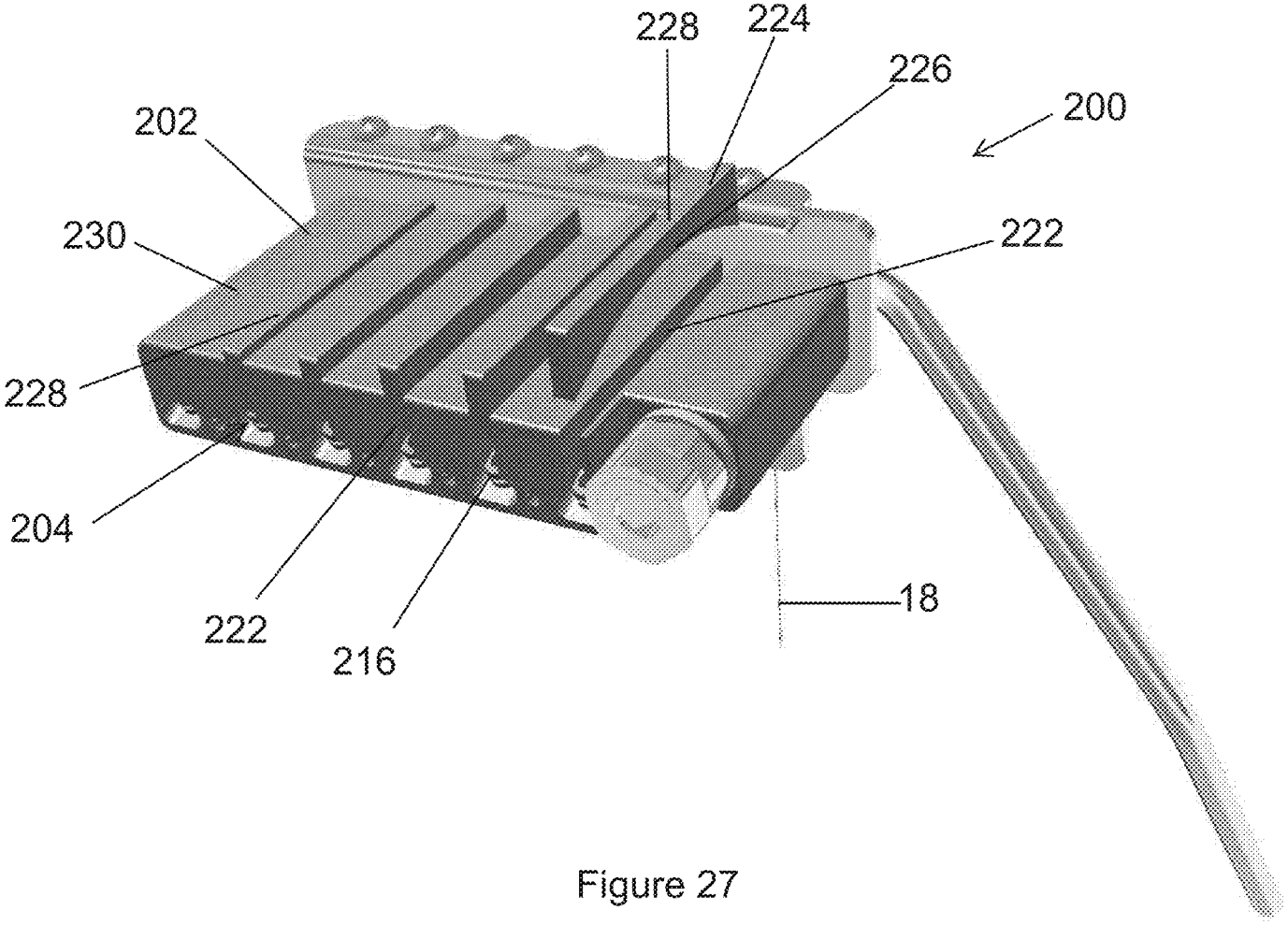
FIG. 27 is a partially exploded bottom perspective view of the tremolo assembly of FIG. 16.
Figure 28:
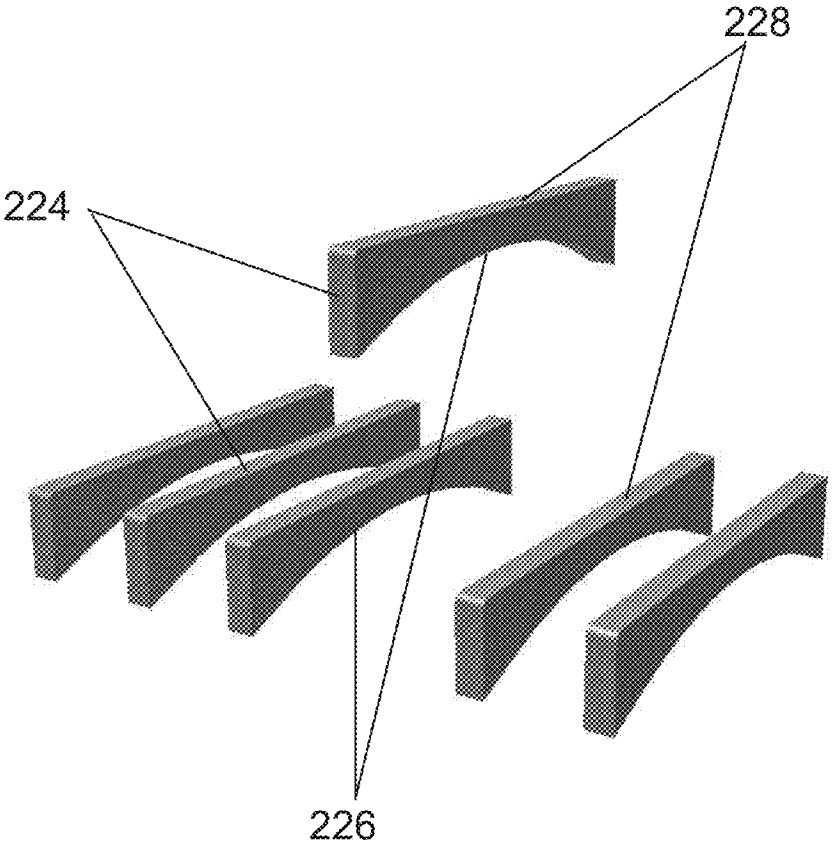
FIG. 28 is a perspective view of inserts from the tremolo assembly of FIG. 16 shown removed from the tremolo block.

In the illustrated embodiment of FIGS. 25, 26, and 27, the concave surface of each insert 224 has a substantially constant radius of approximately 1.725 inches, although other radii can be used. Further, variable radii may be used for the concave surface 226, rather than a constant radius as desired for particular situations. In the illustrated embodiment, the inserts 224 are made of a lightweight material different than the material of the tremolo block 202, thereby reducing the overall weight of the tremolo block assembly. The inserts 224 can be made of, for example, titanium, plastic, Delrin®, Ultem®, or other lightweight materials suitable for acoustic applications.

From the foregoing, it will be appreciated that specific embodiments of the invention have been described herein for purposes of illustration, but that various modifications may be made without deviating from the invention. While embodiments discussed above were configured for use with an electric guitar, the tremolo assembly can be used with other stringed instruments. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

I claim:

1. A bridge assembly for use with a stringed instrument having a plurality of strings, each string having an end portion, the bridge assembly comprising:

A mounting plate attachable to the instrument; and

A bridge block having a top portion connected to the mounting plate and a bottom portion spaced away from the mounting plate, the bridge block having a plurality of arcuate string passageways extending between the top and bottom portions of the bridge block, the arcuate string passageways being configured to receive the strings therein with the strings maintaining contact with the bridge block substantially along the length of the string passageways;

wherein the bridge block has a body portion with a plurality of string slots therein extending between the top and bottom portions, each string slot having a convex surface configured to support the string against the body portion, and the bridge block having a plurality of inserts in the slots, each insert having a concave surface spaced apart from the convex surface of the string slot defining the arcuate string passageway.

2. The bridge assembly of claim 1 wherein each arcuate string passageway has an enlarged opening in the bottom portion, the enlarged opening sized to receive and anchor the end portion of the string in the bridge block.

3. The bridge assembly of claim 1 wherein each arcuate string passageways has an enlarged opening in the bottom portion of the bridge block that receives the end portion of the string therein and blocks the end portion of the string from rotating in the arcuate string passageway.

4. The bridge assembly of claim 1 wherein mounting plate has a plurality of string apertures therein each aligned with a respective one of the plurality of arcuate string passageways and sized to receive a string therethrough.

5. The bridge assembly of claim 1 wherein the bridge block has a tremolo aperture therein configured to receive a tremolo arm therein.

6. The bridge assembly of claim 1 wherein the mounting plate has a first tremolo aperture therein, and the bridge block having a second tremolo aperture therein aligned with the first tremolo aperture, and further comprising a bushing rotatably mounted in the first and second tremolo apertures, the bushing configured to receive a tremolo arm therein.

7. The bridge assembly of claim 1 wherein the bridge block has a plurality of arcuate apertures therein that define the arcuate string passageways.

8. The bridge assembly of claim 1 the body portion is made of a first material and the inserts are made of a second material different than the first material.

9. The bridge assembly of claim 1 wherein each arcuate string passageway having a first portion with first width adjacent to the bottom portion of the bridge block, and each string passageway having a second portion connected to the first portion and having a second width smaller than the first width to define a string retaining shoulder in the bridge block.

10. The bridge assembly of claim 1 wherein the string passageways adjacent to the bottom portion of the bridge block being oriented at an angle relative a bottom surface of the bridge block in the range of approximately 20°-30°.

11. The bridge assembly of claim 1 wherein the arcuate string passageways have a substantially constant radius through the bridge block.

12. The bridge assembly of claim 1 wherein the arcuate string passageways have radius in the range of approximately 1.5 inches-2 inches.

13. A tremolo assembly for use with a stringed instrument having a plurality of strings, each string having a ball end portion, the tremolo assembly comprising:

A mounting plate having a plurality of string apertures and a first tremolo aperture;

A plurality of saddles attached to the mounting plate adjacent to the string apertures;

A bridge block connected to the mounting plate and having a plurality of arcuate string passageways extending between the top and bottom portions of the bridge block, the arcuate string passageways being aligned with the string apertures in the mounting plate and being configured to receive the strings therein with the strings maintaining contact with the bridge block substantially along the length of the string passageways, wherein each of the string passageways has a retention area that receives and retains the ball end portion of the string, the retention area having an elliptical shape cross-sectional shape that defines an enlarged surface area configured to engage the ball end and prevent the ball end from rotating within the string passageway, the bridge block having a second tremolo aperture aligned with the first tremolo aperture; and a tremolo arm removably disposed in the first and second tremolo apertures.

14. The tremolo assembly of claim 13 wherein each arcuate string passageway has a substantially constant radius configured to allow the string to lay smoothly against the tremolo block from substantially the ball end through the entire length of the arcuate string passageway to a too end of the tremolo block.

15. The tremolo assembly of claim 13 wherein the bridge block has a body portion with a plurality of string slots therein extending between the top and bottom portions, each string slot having a convex surface that supports the string against the body portion, and the bridge block having a plurality of inserts in the string slots, each insert having a concave surface spaced apart from the convex surface of the string slot defining the arcuate string passageway.

16. The tremolo assembly of claim 15 wherein the body portion is made of a first material and the inserts are made of a second material different than the first material.

17. The tremolo assembly of claim 13 wherein the string passageways adjacent to the bottom portion of the bridge block being oriented at an angle relative a bottom surface of the bring block in the range of approximately 20°-30°.

18. A guitar assembly, comprising

A neck with a head portion;

A body connected to the neck;

A plurality of strings having a first end portion connected to the head portion of the neck and having a second end portion opposite the first end portion; and A bridge assembly attached to the body, the bridge assembly having a bridge block with a plurality of arcuate string passageways extending between top and bottom portions of the bridge block, the strings extending through the arcuate string passageways with the strings maintaining contact with the bridge block substantially along the length of the string passageways, wherein the second end of the strings being anchored in the bridge block, wherein the bridge block has a body portion plurality of string slots therein extending between the top and bottom portions, each string slot having a convex surface that supports the string against the body portion, and the bridge block having a plurality of inserts in the string slots, each insert having a concave surface spaced apart from the convex surface of the string slot defining the arcuate string passageway.

* * * * *